US006953648B2

(12) United States Patent
Tsujino et al.

(10) Patent No.: US 6,953,648 B2
(45) Date of Patent: Oct. 11, 2005

(54) PROCESS FOR PRODUCING TONER PARTICLES

(75) Inventors: Takeshi Tsujino, Shizuoka (JP); Hitosi Kanda, Kanagawa (JP); Ryoichi Fujita, Tokyo (JP); Yoshinori Tsuji, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/421,779

(22) Filed: Apr. 24, 2003

(65) Prior Publication Data

US 2003/0232269 A1 Dec. 18, 2003

(30) Foreign Application Priority Data

Apr. 24, 2002 (JP) ..... 2002-121848

(51) Int. Cl.[7] ..... G03G 9/08
(52) U.S. Cl. ..... 430/137.17; 430/137.15
(58) Field of Search ..... 430/137.15, 137.17

(56) References Cited

U.S. PATENT DOCUMENTS

| | | | |
|---|---|---|---|
| 2,297,691 | A | 10/1942 | Carlson |
| 4,789,617 | A | 12/1988 | Arahara et al. |
| 4,816,366 | A | 3/1989 | Hyosu et al. |
| 5,272,034 | A | 12/1993 | Kawano et al. |

FOREIGN PATENT DOCUMENTS

| | | | |
|---|---|---|---|
| JP | 36-10231 | | 7/1961 |
| JP | 63-073273 | | 4/1988 |
| JP | 03-096965 | * | 4/1991 ..... 430/137.17 |
| JP | 5-34976 | | 2/1993 |
| JP | 06-194875 | | 7/1994 |
| JP | 8-69126 | A | 3/1996 |
| JP | 10-301330 | A | 11/1998 |

OTHER PUBLICATIONS

USPTO English–language translation of JP 10–301330 (pub. Nov. 1998).*

USPTO English–language translation of JP 03–96965 (pub. Apr. 1991).*

Japanese Patent Office English–Language Abstract Describing JP 03–096965, Copyright 1991.*

Japanese Patent Office Machine–Assisted Translation of JP 10–301330 (pub Nov. 1998).*

* cited by examiner

*Primary Examiner*—Janis L. Dote
(74) *Attorney, Agent, or Firm*—Fitzpatrick, Cella, Harper & Scinto

(57) ABSTRACT

A process for producing toner particles, in which toner particles are produced by polymerizing a polymerizable monomer composition containing at least a polymerizable monomer in an aqueous medium in a vessel, is provided. In this process, a resin composition containing a THF-insoluble resin component, which is a resin component generated in the process for producing toner particles, is kneaded. Then, the kneaded material and the polymerizable monomer are mixed together, and the resulting polymerizable monomer is polymerized to produce toner particles. For the resin composition, toner particles different from those having desired property, deposits on the vessel where the polymerization reaction occurred, or the like is used.

10 Claims, 6 Drawing Sheets

PROCESS FOR PRODUCING TONER PARTICLES

This application claims the right of priority under 35 U.S.C. § 119 based on Japanese Patent Application No. JP 2002-121848 which is hereby incorporated by reference herein in its entirety as if fully set forth herein.

BACKGROUND OF THE INVENTION

1. Field of the Invention

The present invention relates to a process for producing toner particles to be used for visualizing an electrostatic latent image in an image-forming method such as an electrophotography, an electrostatic recording method, a magnetic recording method, or a toner-jet method.

2. Description of the Related Art

Various kinds of methods of electrophotography have been known in the art as described in U.S. Pat. No. 2,297,691 and so on. Typically, the electrophotography forms an electric latent image on a photo conductor by various kinds of means using a photoconductive material, develops the latent image using a toner, and transfers the toner image on a recording material such as a sheet of paper as necessary, followed by fixing the toner image on the recording material by the application of heat and pressure, vapor of solvent, or the like to obtain a copied product. Conventionally, various kinds of methods have been proposed as methods for developing an image using toner or methods for fixing toner images. Of those, methods suitable for the respective image-forming methods have been used.

In recent years, a high speed printing and a high image quality have been desired for electrophotography.

In general, as a process for producing toner, a pulverizing process has been known in the art. The pulverizing process includes the steps of melting and mixing a colorant such as dye or pigments and an additive such as a charging-control agent in a thermoplastic resin, and dispersing the mixture uniformly, followed by pulverizing with a pulverizer and classifying with a classifier to obtain toner with a desired particle size.

However, the production of toner obtained by the pulverizing process is restricted when a releasing agent such as wax is added in the toner. That is, the restrictions for obtaining a sufficient degree of dispersibility of the releasing agent include that (i) at the temperature for kneading with a resin, there is a need to keep the viscosity of a kneaded material at a certain degree, (ii) the content of a releasing agent is about 5 parts by mass or less per 100 parts by mass of toner, and so on. Because of those restrictions, the fixing property of toner produced by the pulverizing process is limited.

In the pulverizing process, further, it is not easy to attain a completely uniform dispersion of solid fine particles of colorant and so on in the resin. Depending on the degree of dispersion, the composition of toner becomes unbalanced and the developing characteristics of toner may be varied. Further, in general, the resolution of an image formed by the toner, the uniformity of a solid portion in the image, the reproducibility of gradation, and so on are largely dependent on the characteristics of toner, in particular on the particle size of toner. That is, the smaller the particle size of toner, the higher the quality of an obtained image. Therefore, toner having a small particle size is used in most of recent printers, high-quality copying machines, and so on. However, in making the toner particles small by a pulverizing process, a volume average particle size of about 5.0 $\mu$m is the limit due to the ability of a pulverizer.

Further, in this pulverizing process, a step of classifying the resulting toner is indispensable for obtaining predetermined particle size and particle size distribution. Therefore, since this step generates fine particles and coarse particles in addition to the toner having a predetermined particle size, various contrivances have been made with respect to the producing process for achieving reutilization thereof.

Further, the above coarse particles are pulverized again in the producing step, so that the coarse particles are made into fine particles. On the other hand, as described in JP-A-5-34976, and so on, the fine particles are conventionally reutilized recycling a predetermined amount of the powder in the step of mixing raw materials, due to considerations regarding the environment, production costs, and the like. However, this process is not preferable because of the following reasons. That is, at the time of melting and kneading the above fine particles again by a kneading machine, the resin molecules in the fine particles are cleaved again to decrease the molecular weight of the resin component. At the time of fixing the toner on the paper, therefore, the deterioration of the fixing performance such as hot offset occurs. In addition, as the mechanical strength of toner decreases, the durability of performance of the toner becomes deteriorated.

For improving those problems in the conventional methods, in JP-A-8-69126, and soon, various contrivances have been proposed, such as processing fine particles before charging them into the process for kneading. The reutilization of toner by charging fine particles into the process for kneading is broadly performed as a well-known technique in the art for providing an economical and productive process for producing toner.

In contrast, there is also proposed a process for producing toner in which a polymerizable monomer composition containing at least a polymerizable monomer is suspended and polymerized while simultaneously obtaining toner particles (JP-B-36-10231). Hereinafter, toner obtained by such a process will be referred to as "polymerized toner". This suspension polymerization is a process in which a polymerizable monomer and a colorant (optionally, also a polymerization initiator, a crosslinking agent, and other additives) are uniformly dissolved or dispersed to obtain a polymerizable monomer composition, followed by dispersing the polymerizable monomer composition in a continuous phase (e.g., an aqueous phase) containing a dispersion stabilizer using an appropriate stirrer while allowing a polymerization reaction to occur at the same time, thus obtaining toner particles having a desired particle size. Attention has been recently particularly focused on this process because it has various advantages without having any of the restrictions associated with the pulverizing process described above.

In other words, with regard to the content of a releasing agent and the dispersibility thereof, the above polymerized toner can contain a certain amount of the releasing agent in the inside of a toner particle. Therefore, it is possible to increase the content of the releasing agent in this process, as compared with the pulverizing process. In this case, further, the dispersibility of the releasing agent can be simultaneously satisfied. Further, a colorant can be also uniformly dissolved or dispersed in the polymerizable monomer together with other additives, so that there is no particular problem regarding the dispersibility of the colorant. Depending on the conditions of dispersion and granulation, desired particle size and particle size distribution can be controlled, so that there is another advantage in that the polymerized toner can be used for the production of small-sized toner particles.

However, the polymerized toner has the following disadvantages to be solved.

That is, regarding the polymerized toner, the aggregation of particles occurs during a polymerization reaction depending on the reaction conditions and the formulation of toner. As a result, aggregates of polymerized particles are adhered on the wall surface of a reaction vessel, a stirring blade, and so on. In addition, it is not easy to completely exclude the mixture of these coarse particles even under the producing conditions in which the particle size distribution width of toner particles is narrowed by the steps of dispersion and granulation and the aggregation of particles is prevented as much as possible by various kinds of techniques.

On the other hand, a dispersant is used for narrowing the particle size distribution width of toner particles. Depending on the concentration of the dispersant in a water phase and the conditions for adding the dispersant to be used, a polymerization reaction is accompanied even in the water phase, so that ultra-fine particles of 0.1 to 1 $\mu$m in diameter or less may be generated. The presence of such ultra-fine particles causes problems with respect to the image characteristics of toner (i.e., the density of a solid image, the uniformity of an image density, fogging, and so on) because distribution of the colorant or the like is not uniform in the ultra-fine particles. Moreover, in the case of toner in which the ultra-fine particles are adhered on the surface of toner particles, similar problems occur in terms of the image characteristics of toner because the property of toner such as flowability and charging controllability are changed.

With the trend toward a higher-quality image of electrophotograph, further narrowing of the particle size distribution is required of polymerized toner. In the current techniques, even if granulation conditions are optimized, it is often necessary to decrease the percentages of fine particles of 4 $\mu$m or less in particle size and coarse particles of 10 $\mu$m or more in particle size in the toner.

In addition, from the different viewpoint, the polymerized toner is typically designed as particles where each particle has a core shell structure comprised of at least two layers by incorporating a releasing agent, a low-energy fixing component, and so on in the particle. In this kind of the polymerized toner, when toner particles that are beyond predetermined ranges of particle size distribution and particle size distribution width are generated in some form or another, the reutilization of toner cannot be simply attained just as in the case with the toner obtained by the pulverizing process. This problem is an important issue to be solved in view of the yield of toner.

On this point, JP-A-10-301330 proposes dissolving a kneaded material containing a THF insoluble resin component other than the desired toner particles in a polymerizable monomer and then recycling it. In this proposal, the soluble components in non-desired toner components are only used. In other words, the insoluble components cannot be used, so that a recycling rate of the toner is not 100%. Consequently, there is a need to further improve the recycling rate of the toner.

SUMMARY OF THE INVENTION

An object of the present invention is to provide a process for producing toner particles which solves the problems as described above.

In other words, it is an object of the present invention to provide a process for producing toner particles by a polymerization process, which is characterized by recycling a kneaded material that contains a THF-insoluble resin component other than the desired toner particles produced in the process for producing toner particles, in a process for producing polymerized toner.

Further, from the ecological viewpoint, another object of the present invention is to provide a process for producing toner particles, which achieves the recycling of polymerized toner, is economical and eliminates waste while providing stable toner particles that allow high image densities without fogging.

The invention relates to a process for producing toner particles, in which a polymerizable monomer or a polymerizable monomer composition containing at least a polymerizable monomer is polymerized in an aqueous medium in a vessel to produce toner particles, the process comprising the step of kneading a mixture containing at least a THF-insoluble resin component other than desired toner particles generated in the process for producing the toner particles, thereby generating a kneaded material which is reduced an amount of the THF-insoluble resin component in the mixture; pulverizing the kneaded material to obtain powder of the kneaded material; and adding the powder of the kneaded material into a polymerizable monomer or a polymerizable monomer composition.

DETAILED DESCRIPTION OF THE INVENTION

Figure 1:
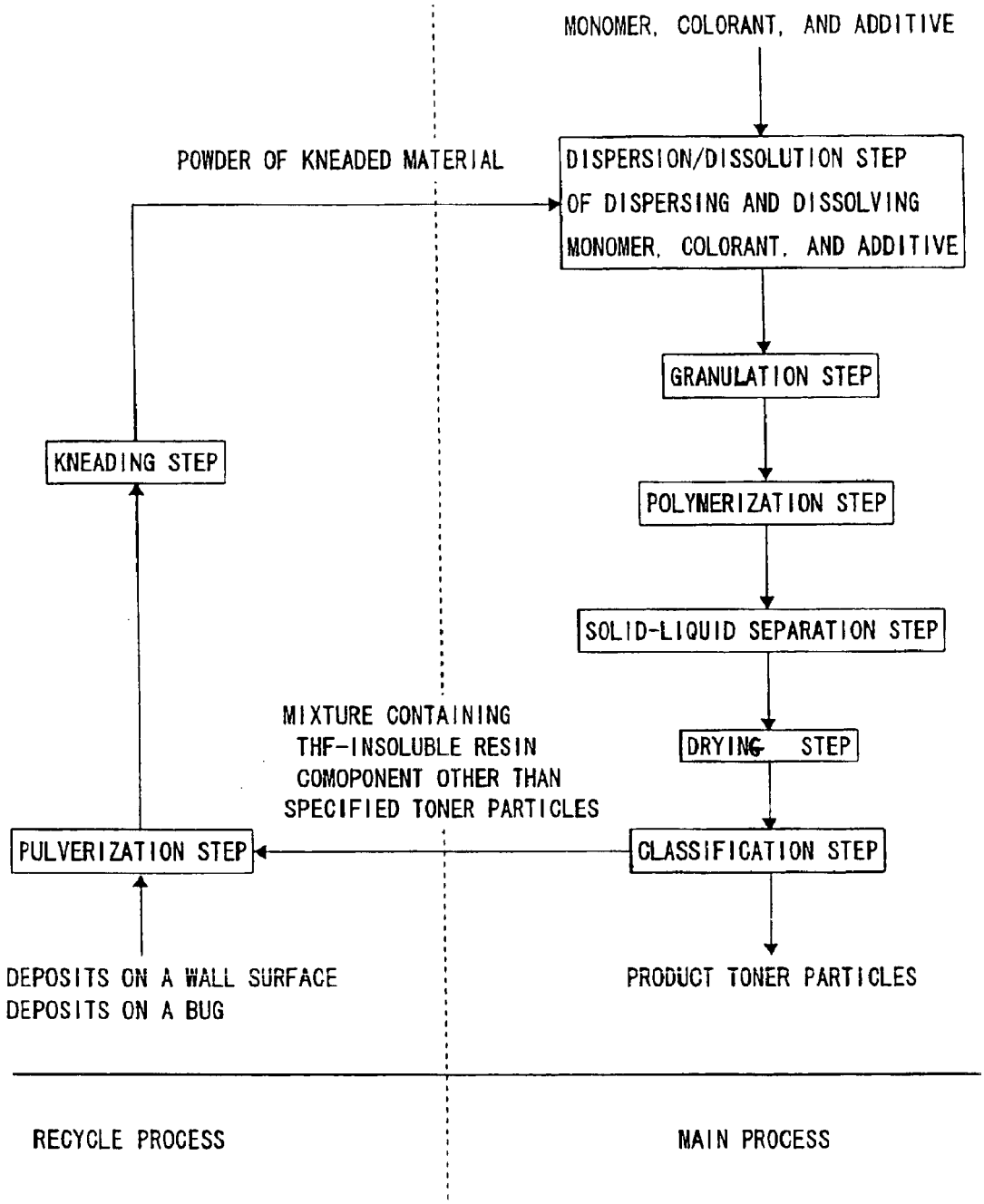
FIG. 1 is a flow chart for illustrating an example of the whole flow of a process for producing toner particles of the present invention.
Figure 2:
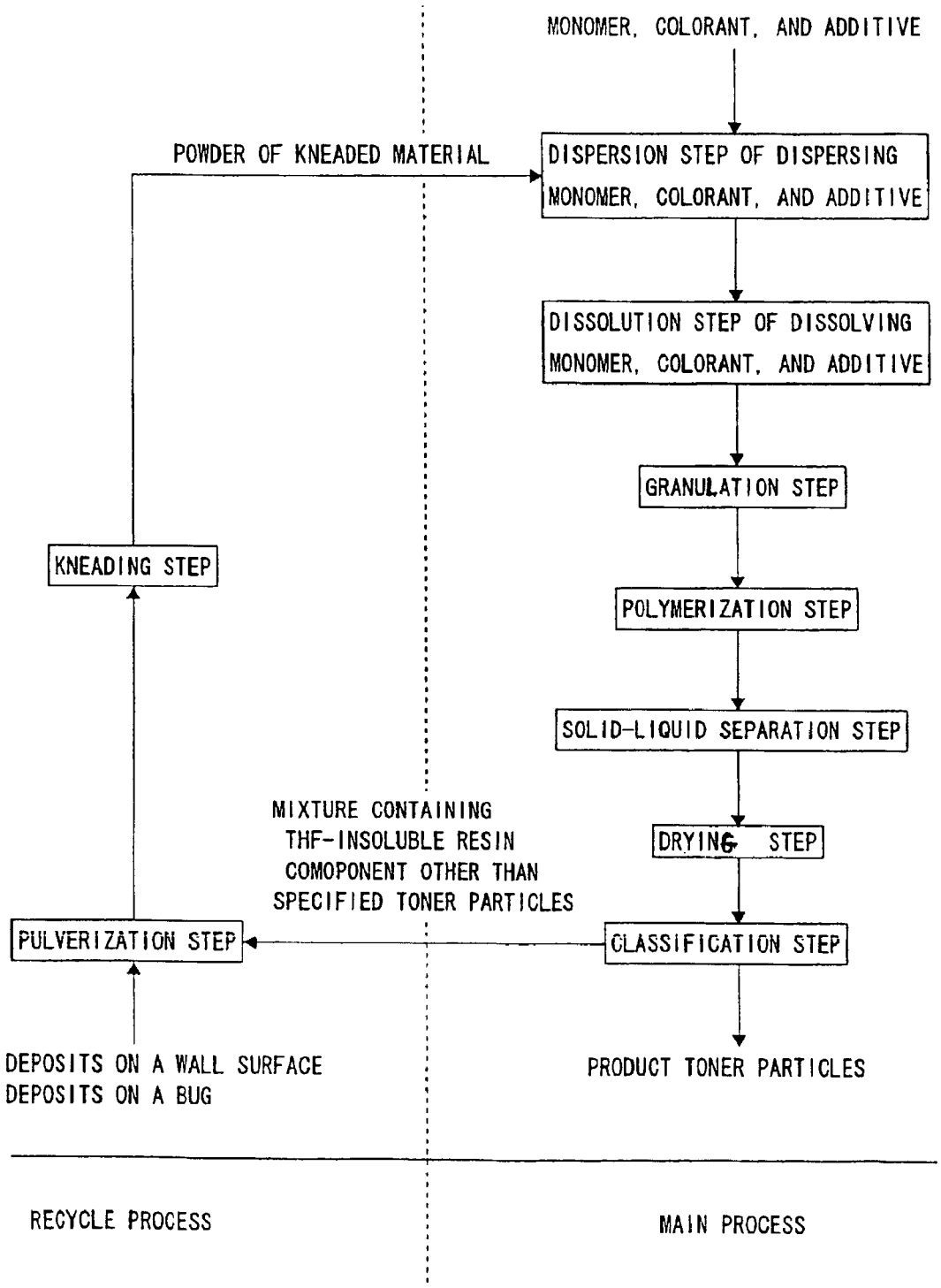
FIG. 2 is a flow chart for illustrating an example of the whole flow of the process for producing toner particles of the present invention.

Each of FIGS. 1 and 2 shows a flow chart that illustrates the whole flow of a process for producing toner particles in accordance with the present invention. The production of toner consists of a main process and a recycling process.

In each FIGS. 1 and 2, a mixture that contains a THF-insoluble resin component other than desired toner particles includes coarse particles, fine particles, and ultra-fine particles, which are separated and removed by the classifying step in each of FIGS. 1 and 2. In addition, toner particles having beyond a predetermined range of the particle size distribution or particle size distribution width because of variations in the producing conditions, and polymerized toner particles or the like having the physical property of toner (e.g., molecular weight and molecular-weight distribution) which are different from predetermined physical property because of abnormalities occurring during the reaction of polymerized toner can be also used as the above mixture. In addition, deposits on the wall surface of a reaction vessel in which the polymerization reaction of the polymerizable monomer is performed can be also used as the THE-insoluble resin component other than desired toner particles (non-desired toner).

The polymerized toner particles are designed as particles where each particle has a core shell structure in which a releasing agent or the like is incorporated in the particle as described above, so that these particles cannot be recycled in a simple manner as described above. However, the inventors have made extensive studies and found that the process described below enables recycling of components other than the above desired toner particles.

Specifically, the process for recycling a mixture that contains a THF-soluble resin component other than the desired toner particles will be described below:

At first, a mixture (ultra-fine particles, fine particles, coarse particles, deposits on a vessel used for polymerization, and so on) that contains a THF-insoluble resin component other that the desired toner particles to be recycled is kneaded and pulverized to prepare powder of a kneaded material. At the time of kneading, the mixture containing the THF-insoluble resin component receives the application of a shearing force or the like to cleave a molecular chain of the THF-insoluble resin component in the mixture. As a result, the content of the THF-insoluble resin component in the mixture decreases so that it can be dissolved and dispersed uniformly in a polymerizable monomer or a polymerizable monomer composition (hereinafter, referred to as "a polymerizable monomer system").

An apparatus used in the step of generating the kneaded material may be one of those commercially available apparatuses, for example, a three-roll mill, a screw kneader, or a kneader. Operation conditions such as temperature, the number of revolutions, feeding amount, and preparation amount, which affect the cleavage of the THF-insoluble resin component at the time of kneading, may be appropriately determined to the most favorable conditions according to the THF-insoluble resin component in the mixture that contains the THF-insoluble resin component other than the desired toner particles, the melting temperature of the kneaded material that contains the THF-insoluble resin component other than the desired toner particles, a kneading apparatus, or the like.

Further, in the case of a continuous kneading process, the kneading is preferably repeated appropriately when the THF-insoluble resin component is not sufficiently reduced in the kneaded material by a single pass of the kneading.

The amount of powder of the kneaded material to be added into a polymerizable monomer or a polymerizable monomer composition is preferably in the range of 0.1 to 30% by mass, more preferably in the range of 0.1 to 20% by mass, and most preferably in the range of 0.1 to 10% by mass. Here, the mixture that contains the THF-insoluble resin component other than the desired toner particles include a polymerizable monomer, a colorant, a resin component, a releasing agent, and a polymerization initiator, and do not include an external additive or the like.

It is not preferable when the amount of the powder of the kneaded material to be added into a polymerizable monomer or a polymerizable monomer composition is more than 30% by mass because of the following reasons. That is, the kneaded material tends to be unevenly dissolved or swollen. In addition, such nonuniformity of the kneaded material cannot be improved even though the dissolving or swelling time is extended. The viscosity of the solution containing the kneaded material added into the polymerizable monomer system also becomes extremely high so that the particle size distribution at the time of the granulation step becomes broadened. Further, when the amount of the above powder is less than the lower limit, it is not preferable because no economical advantage can be attained by the reutilization.

The amount of the THF-insoluble resin component in the powder of the above kneaded material is preferably 40% by mass or less, more preferably 35% by mass or less, and most preferably 20% by mass or less. When the THF-insoluble resin component is more than 40% by weight, it is not preferable because of the following reasons. That is, the cleavage of a molecular chain in the THF-insoluble resin component is insufficient. Thus, the amount of the powder of the kneaded material added that can be uniformly dissolved in a polymerizable monomer or a polymerizable monomer composition is small. Therefore, there are only few cost merits. In addition, it is difficult to attain 100% reutilization of the kneaded material containing a THF-insoluble resin component other than desired toner particles, which is not preferable.

It is preferable that the content of the THF-insoluble resin component in the mixture is 60% by mass or more, where the mixture contains a THF-insoluble resin component other than the desired toner particles generated in the producing process of the toner particles, and the content of the THF-insoluble resin component in the powder of the kneaded material obtained by kneading for reducing the THF-insoluble resin component is 40% by mass or less. It is preferable that the mixture that contains 60% by mass or more of the THF-insoluble resin component other than the desired toner particles is subjected to a kneading processing, so that a large reduction in the THF-insoluble resin component in the mixture can be observed and therefore the THF-insoluble resin component can be effectively recycled to the toner particles.

Next, a description will be given of the step of adding the powder of the kneaded material into a polymerizable monomer or a polymerizable monomer composition and dispersing and dissolving the powder therein.

In a process for producing toner particles, when there is good compatibility between a colorant and a polymerizable monomer to be used and the colorant can be easily dispersed, the powder of the kneaded material is dissolved in the polymerizable monomer system using a vessel and a stirring apparatus which are typically used in the art to obtain a uniform polymerizable monomer dispersion liquid. In addition, a uniform polymerizable monomer dispersion liquid is obtained by adding the powder of the kneaded material, a polymerizable monomer, optionally also a colorant, optionally still also an additive such as a charging-control agent, a releasing agent, a polar resin, a magnetic substance, and so on into a vessel. Particularly, when the colorant is a surface-treated magnetic substance or the like, it is not preferable to disperse the colorant with the conventional media mill because the surface-treated portion of the magnetic substance is damaged. In this case, it is important that the stirring apparatus has at least two different stirring blades separately performing the function of dispersing pigments and the powder of the kneaded product and the function of uniformly stirring and mixing.

In other words, it may perform dispersing the pigments and uniformly stirring and mixing wax and so on within a single vessel by using a blade that is effective for dispersing the pigments and a blade for uniformly stirring and mixing the whole contents. At this time, as an example of a predetermined configuration of the blade to be used, there may be given a blade that effectively imparts a shearing force, such as a disk turbine blade, or a nozzle type homogenizer (Clearmix, manufactured by M Technique Co., Ltd., or TK Homomixier, manufactured by Tokushu Kika Kogyo Co., Ltd.). Of those, the disk turbine blade is preferable. When a mass production is assumed, device cost of the nozzle type homogenizer is high. Therefore, it is not preferable from the viewpoint of cost reduction of the producing apparatus. Further, the disk turbine blade may be selected from various blade forms. Of those, however, an edged turbine blade is particularly preferable. The edged turbine blade is preferred because it has a plurality of edges on the outer periphery of the blade and those edges are very effective for breaking the aggregation of pigments and dissolving the powder of the kneaded product. In addition, the blade effective for uniformly stirring and mixing the whole contents of the vessel may be an anchor blade or the like that uniformly stirs and mixes the whole contents of the vessel.

As described above, the dispersing step and dissolving step are performed in the same vessel, so that a cost reduction can be attained as compared with the prior art. In addition, the stirring apparatus used at this time has at least two different stirring blades. Therefore, shearing forces can be continuously applied to the polymerizable monomer dispersion liquid until just before the next step, i.e., the granulation step where the polymerizable monomer dispersion liquid is added into an aqueous medium to generate toner particles. In addition, as the inside of the reaction vessel can be uniformly stirred and mixed, it can prevent the pigments from being aggregated again and from being precipitated to the bottom of the vessel. Consequently, according to the process for producing toner particles in accordance with the present invention, toner having a very narrow particle size distribution in which pigments are evenly dispersed can be efficiently produced.

However, in the case where the pulverization and dispersion of a colorant are required, such as when the colorant has a particle size larger than a desired particle size, there is a need of dispersing at least the colorant and the polymerizable monomer using a media type mill. Subsequently, the dispersed product is transferred to the step of adding the power of the kneaded material into the polyemerizable monomer system, followed by dissolving other additives or the like therein using vessel and a stirring apparatus which are typically used in the art. At this time, with respect to a resin component other than the desired toner particle, there is no difference in dispersion and dissolution states of the processed product when it was introduced into each of the dispersion and dissolution steps, so that it can be appropriately added into the polymerizable monomer system to obtain polymerizable monomer dispersion liquid. Representative media type mills which can be used in the present invention include a ball mill, an attritor, a sand mill, and a bead mill, preferably CO-BALL mill manufactured by Shinko Pantec Co., Ltd., a Dyno-Mill manufactured by Shinmaru Enterprises Corporation, an APEX mill manufactured by Kotobuki Engineering & Manufacturing Co., Ltd., a continuous attritor, a Handy mill, and a SC mill manufacturing by Mitsui Mining Co., Ltd., and so on.

The polymerizable monomer dispersion liquid obtained as described above is introduced into the ordinary process cycle (granulation, dispersion, polymerization, and solid-liquid separation) for producing polymerized toner to allow the reutilization of a resin component such as undesired toner component generated in the toner production process. Therefore, there is provided a process for producing toner particles which is superior from an ecological viewpoint and economical without waste.

In the above polymerizable monomer containing the recycled component, there are components which can be incorporated in the particles, such as a releasing agent, a colorant, other additives, and a resin having a comparatively low molecular weight component which is soluble in polymerizable monomer, and so on. They are uniformly dissolved in the polymerizable monomer and are dissolved and dispersed together with other raw materials of toner particles, such as a polymerizable monomer system of a new batch. Therefore, they present no problem with respect to the non-uniformities.

Further, the addition amount of the kneaded material (toner particles whose usage is limited to be directed for the reutilization) that contains the THF-insoluble resin component other than the desired toner particles to be added into the polymerizable monomer system is strictly managed to keep the stability of the formulation of toner by back calculation of the amount of a polymerizable monomer system to be added as a new batch and the amount of other raw materials of toner particles.

Further, there is a comparatively low molecular weight component in the kneaded material. Therefore, there is also an advantage that a low-temperature fixing property of toner is improved as the ratio of a low molecular weight resin component in the polymerized toner particles to be produced is increased.

A magnetic substance to be used in the production of magnetic toner in the process for producing toner particles of the present invention will be described below.

In the magnetic substance used in the present invention, when the particle surface of the magnetic substance is to be made hydrophobic, it is very preferable to use a process in which the magnetic substance particles are dispersed in an aqueous medium so as to have primary particle sizes and are then subjected to a surface treatment while hydrolyzing a coupling agent. According to this process for imparting hydrophobic property, the magnetic substance particles are less liable to combine with each other as compared with the case where processing is performed in the gas phase. In addition, there is exerted a charging repulsion action between the magnetic particles, so that the magnetic substance can be surface-treated almost as primary particles.

In the process for treating the surface of the magnetic substance while hydrolyzing the coupling agent in the aqueous medium, there is no need to use coupling agents that cause the generation of gas, such as chlorosilanes and silazanes. In addition, it becomes possible to use a coupling agent having a high viscosity, with which it has been difficult to perform the treatment in a good manner because the magnetic substance particles easily combine with each other in the gas phase. Consequently, the hydrophobic property imparting effect is quite substantial.

Examples of the coupling agents which can be used in the surface treatment on the magnetic substance in accordance with the present invention include, for example, a silane coupling agent and a titanium coupling agent. Preferably, the silane coupling agent which can be represented by the following chemical formula is used.

$$R_mSiY_n$$

(wherein R denotes an alkoxy group, m denotes an integer of 1 to 3, Y denotes a hydrocarbon group such as an alkyl group, a vinyl group, a glycidoxy group, and a methacryl group, and n denotes an integer of 1 to 3). Examples thereof include vinyltrimethoxysilane, vinyltriethoxysilane, vinyltris (β-methoxyethoxy) silane, β-(3,4-epoxycyclohexyl) ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hydroxypropyltrimethoxysilane, n-hexyldecyltrimethoxysilane, n-octadecyltrimethoxysilane, and the like.

Of those, for improving the dispersibility of the magnetic substance, it is preferable to use a silane coupling agent having a double bond, more preferably phenyltrimethoxysilane, γ-methacryloxypropyltrimethoxysilane, and γ-glycidoxypropyltrimethoxysilane. This is because, in the case of performing a suspension polymerization in particular, the compatibility between the magnetic substance and the polymerizable monomer in the toner particles becomes good when the magnetic substance is treated with the coupling agent having a double bond.

However, in the case of using only the coupling agent having the double bound, it is difficult to impart a sufficient hydrophobic property to the magnetic substance, so that the particle size distribution of toner may be broadened due to such influences that the magnetic substance having insufficient hydrophobic property is exposed on the surface of toner, or the like. Even though the reason for the above case is not clear, however, it is presumably because the hydrophobicity of the coupling agent itself, the reactivity of the active group on the surface of the magnetic surface, and the covering property of the surface of the magnetic substance are poor. Therefore, for obtaining sufficient hydrophobicity, it is more preferable to simultaneously use an alkyl trialkoxysilane coupling agent represented by the following formula.

$$C_pH_{2p+1}—Si—(OC_qH2_{q+1})_3$$

(wherein p denotes an integer of 2 to 20 and q denotes an integer of 1 to 3)

In the above formula, if p is smaller than 2, a hydrophobic processing becomes easy. In this case, however, it is difficult to provide the magnetic substance with sufficient hydrophobicity, resulting in difficulty in preventing the exposure of magnetic particles from the toner particles. In addition, if p is larger than 20, the magnetic substance is provided with sufficient hydrophobicity. In this case, however, more magnetic substance particles are combined together, resulting in difficulty in sufficiently dispersing the magnetic substance particles. Thus, the particle size distribution can be broadened.

Further, if q is larger than 3, the reactivity of the silane coupling agent decreases so that it becomes difficult to obtain sufficient hydrophobic property.

In particular, it is preferable to use an alkyl trialkoxysilane coupling agent that represents the above formula in which p denotes an integer of 2 to 20 (more preferably an integer of 3 to 15) and q denotes an integer of 1 to 3 (more preferably an integer of 1 or 2).

The processing amount thereof is in the range of 0.05 to 20 parts by mass with respect to 100 parts by mass of the magnetic substance, preferably in the range of 0.1 to 10 parts by mass. It is preferable that the processing amount of the silane coupling agent is adjusted depending on the surface area of the magnetic substance and the reactivity of the coupling agent.

Here, the term "aqueous medium" means a medium in which water is a major component. Specifically, the aqueous medium may be water itself, water with an addition of a small amount of a surfactant, water with an addition of a pH adjuster, water with an addition of an organic solvent, or the like. The surfactant is preferably a non-ionic surfactant such as polyvinyl alcohol. It is preferable to add the surfactant at an amount of 0.1 to 5% by mass with respect to water. The pH adjuster may be an inorganic acid such as hydrochloric acid, and the organic solvent may be alcohols or the like.

In the case of using two or more different kinds of silane coupling agents, these coupling agents may be charged simultaneously or one by one at intervals over time to process the magnetic substance.

In the magnetic substance thus obtained, there is observed no aggregation of particles. In addition, the surface of each particle is uniformly provided with hydrophobic property, so that the dispersibility of the magnetic substance becomes excellent.

The magnetic substance to be used in the present invention may contain phosphorous, cobalt, nickel, copper, magnesium, manganese, aluminum, silicon, or the like. In addition, the magnetic substance may be mainly comprised of iron oxide such as triiron tetroxide or λ-iron oxide. In this case, one kind of or two or more kinds of iron oxide may be simultaneously used. The magnetic substance has preferably a BET specific surface area of 2 to 30 $m^2/g$, in particular 3 to 28 $m^2/g$, and preferably a Mohs' hardness of 5 to 7.

In the present invention, the amount of the magnetic substance to be used is preferably in the range of 10 to 200 parts by mass, more preferably 20 to 180 parts by mass with respect to 100 parts by mass of the binder resin. If the usage amount of the magnetic substance is less than 10 parts by mass, the staining power of toner is poor and it is difficult to prevent the generation of fogging. On the other hand, if the usage amount of the magnetic substance is more than 200 parts by mass, the retentivity of toner to the toner carrier by magnetic force is enhanced so that the developing ability of toner decreases, or uniform dispersion of the magnetic substance to each of toner particles becomes difficult. As a result, the fixing property of toner may decrease.

Further, the content of the magnetic substance in toner particles can be measured using a thermal analyzer (TGA 7; manufactured by PerkinElmer Japan Co., Ltd.). The measuring process may include heating toner particles from ordinary temperature to 900° C. at a rate of temperature increase of 25° C. per minute in nitrogen atmosphere, defining a mass loss % from 100° C. to 750° C. as the amount of the binder resin, and approximately defining a residual mass as the amount of the magnetic substance.

The magnetic substance to be used in the present invention is produced by the following process, for example in the case of magnetite.

An equivalent weight or more of alkali such as sodium hydroxide with respect to an iron component is added into a ferrous salt solution to prepare an aqueous solution containing iron hydroxide. The pH of the prepared aqueous solution is kept at pH 7 or more (preferably pH 8 to 14) while blowing the air thereto. The aqueous solution is heated to 70° C. or more to initiate an oxidation reaction of iron hydroxide. Consequently, a seed crystal to be provided as a core of magnetic iron oxide particle is generated at first.

Subsequently, the aqueous solution containing about one equivalent weight of ferrous sulfate is added in a slurry liquid containing the seed crystal on the basis of the addition amount of alkali previously added therein. Then, the air is blown into the liquid while keeping the solution at pH 6 to 14 to promote the oxidation reaction of iron hydroxide. Thus, the magnetic iron oxide particles are grown using the seed crystal as a core. As the oxidation reaction advances, the pH of the liquid shifts to the acidity side. However, it is preferable not to make the pH of the liquid less than 6. The pH of the liquid is adjusted in the terminal phase of the oxidation reaction and the liquid is then stirred sufficiently to make the magnetic iron oxide into primary particles. Subsequently, a coupling agent is added in the liquid, followed by mixing and stirring sufficiently. After stirring, the liquid is filtered, dried, and slightly pulverized to obtain magnetic iron oxide particles that have been subjected to a hydrophobicity processing.

Alternatively, the process may be carried out as follows. That is, after completing the oxidation reaction, the iron oxide particles obtained after washing and filtration are re-dispersed in another aqueous medium without drying. Then, the pH of the re-dispersion liquid is adjusted and the liquid is then sufficiently stirred, while adding a silane coupling agent therein to carry out a coupling processing. In any case, an important point in the present invention is to perform the processing of the surface of iron oxide particles without passing through the drying of iron oxide particles that are obtained after completing the oxidation reaction.

Ferrous salt to be used may be typically ferrous sulfate which is a byproduct of the sulfuric acid process titanium production, or ferrous sulfate which is a byproduct of surface-washing of a steel plate. Further, iron chloride or the like may be used.

In the process for producing magnetic iron oxide using an aqueous solution, generally, a solution having an iron concentration of 0.5 to 2 mol/1 is used for preventing an increase in viscosity at the time of the reaction and from the viewpoint of the solubility of ferrous sulfate. In general, the particle size of the product tends to become small as the concentration of ferrous sulfate decreases. Further, the larger the amount of air, and the lower the reaction temperature, the more easily the product becomes fine particles.

Therefore, using magnetic toner having hydrophobic magnetic substance particles thus obtained as a raw material thereof, stable electrostatic property of toner is obtained. In addition, an image formation with high transfer efficiency, high image quality, and high stability becomes possible.

Next, as colorants other than the magnetic substance which can be suitably used in the process for producing toner particles of the present invention, carbon black and yellow/magenta/cyan colorants shown below may be given as examples.

As the yellow colorants, there are used compounds as represented by condensed azo compounds, isoindolinone compounds, anthraquinone compounds, azo metal complexes, methine compounds, and allylamide compounds. Specifically, C.I Pigment Yellow 12, 13, 14, 15, 17, 62, 74, 83, 93, 94, 95, 109, 110, 111, 128, 129, 147, 168, 180, etc. are suitably used.

As the magenta colorant, there are used condensed azo compounds, diketopyrrolopyrrole compounds, anthraquinone, quinacridone compounds, basic dye lake compounds, naphthol compounds, benzimidazolone compounds, thioindigo compounds, and perylene compounds. Specifically, C.I Pigment Red 2, 3, 5, 6, 7, 23, 48:2, 48:3, 48:4, 57:1, 81:1, 122, 146, 166, 169, 177, 184, 185, 202, 206, 220, 221, 254, etc. are particularly preferable.

In the present invention, as the cyan colorant, there may be used copper phthalocyanine compounds and derivatives thereof, anthraquinone compounds, basic dye lake compounds, and the like. Specifically, C.I Pigment Blue 1, 7, 15, 15:1, 15:2, 15:3, 15:4, 60, 62, 66, etc. are particularly suitably used.

Those colorants may be used independently or in combination, and may be used as a solid solution. The colorant can be selected on the basis of hue angle, chroma, lightness, weatherability, OHP transparency, and dispersibility to toner particles. The addition amount of the colorant is in the range of 1 to 20 parts by mass with respect to 100 parts by mass of the resin.

Examples of releasing agents that may be used in the present invention include: petroleum wax such as paraffin wax, microcrystalline wax, and petrolatum, and derivatives thereof; montan wax and derivatives thereof; hydrocarbon wax with Fischer-Tropsch process and derivatives thereof; polyolefin wax such as polyethylene and derivatives thereof; natural wax such as carnauba wax and candelila wax and derivatives thereof, and so on. Examples of the derivatives include oxides, block copolymers with vinyl monomers, and graft denatured products. Further, there may be also used fatty acids such as higher aliphatic alcohol, stearic acid, and palmitic acid, or compounds thereof; acid amide wax, ester wax, ketone, hardened castor oil, and derivatives thereof; plant wax; and animal wax.

In the process for producing toner particles of the present invention, a charging-control agent may be blended. The charging-control agent may be one commonly known in the art. Further, in the case of producing toner particles using a polymerization process directly, it is particularly preferable to use a charging-control agent with a low polymerization inhibiting effect and having substantially no substance soluble in the aqueous medium. A specific example of the charging-control agent may be, as a negative-control agent, a metal compound of aromatic carboxylic acid such as salicylic acid, alkyl salicylic acid, dialkyl salicylic acid, naphthoic acid, or dicarboxylic acid, a metal salt or a metal complex of azo dye or azo pigment, a polymer compound having a sulfonic acid group or a carboxyl group on its side chain, a boron compound, an urea compound, a silicon compound, carixarene, or the like. As a positive charging-control agent, a specific example thereof may be quaternary ammonium salt, a polymer compound having quaternary ammonium salt on its side chain, a guanidine compound, a nigrosine compound, an imidazole compound, or the like.

As a process for introducing a charging-control agent into toner particles, there are a process for adding the agent into the inside of toner particles and a process for externally adding it to toner particles. The usage amount of the charging-control agent is determined according to the conditions employed for the process for producing toner particles, such as the type of a binder resin, the presence or absence of other additives, and the process for dispersion. Thus, even though it is not uniquely defined, the amount of the charging-control agent is preferably in the range of 0.1 to 10 parts by mass, more preferably 0.1 to 5 parts by mass with respect to 100 parts by mass of the binder resin when the agent is internally added in the toner particles. In the case of external addition, the amount is preferably 0.005 to 1.0 part by mass, more preferably 0.01 to 0.3 parts by mass with respect to 100 parts by mass of the toner.

Polymerizable monomers that constitute a polymerizable monomer system to be used in the process for producing toner particles of the present invention can be shown as follows.

The polymerizable monomers include: styrene monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide.

In the process for producing toner particles of the present invention, the poltmerizable monomer may be polymerized with a resin added in the polymerizable monomer system. For instance, in the case of a polymerizable monomer having a hydrophilic functional group such as amino group, carboxylic group, hydroxyl group, sulfonic acid group, glycidyl group, and nitrile group, it cannot be used because it is water-soluble so that a monomer which has it is dissolved in an aqueous suspension to cause emulsion polymerization. If it is desired to introduce such a polymerizable monomer into toner particles, it can be used when it is modified into the form a copolymer such as a random copolymer, a block copolymer, or graft copolymer with a vinyl compound of styrene or ethylene, a polycondensation product with polyester, polyamide, or the like, or a polyaddition product with polyether, polyimine, or the like.

Now, an alcohol component and an acid component that constitute a polyester resin to be used in the present invention are exemplified as follows. That is, the alcohol component may be ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, cyclohexane dimethanol, butene diol, octene diol, cycrohexene dimethanol, hydrogenated bisphenol A, bisphenol derivative represented by the following formula (I):

(I)

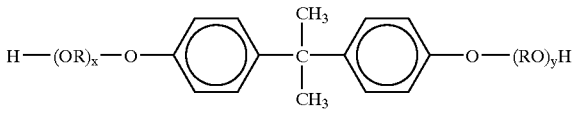

(wherein R is an ethylene group or a propylene group, each of x and y is an integer of 1 or more, and an average of x+y is 2 to 10), or a hydrogenated product of the compound of the formula (I), or diol represented by the following formula (II):

(II)

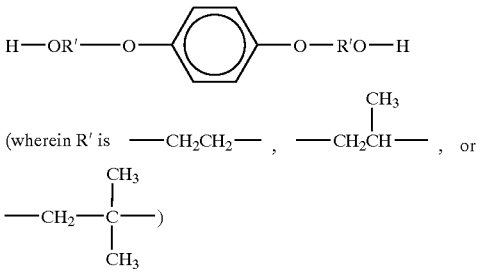

or a hydrogenated product of the compound of the formula (II).

The divalent carboxylic acids include: benzenedicarboxylic acids and anhydrides thereof such as phthalic acid, terephthalic acid, isophthalic acid, and phthalic anhydride; alkyldicarboxylic acids and anhydrides thereof such as succinic acid, adipic acid, sebacic acid, and azelaic acid; and further, succinic acids substituted by an alkyl or alkenyl group having 6 to 18 carbon atoms, and anhydrides thereof; unsaturated dicarboxylic acids and anhydrides thereof such as fumaric acid, maleic acid, citraconic acid, and itaconic acid; and the like.

Further, the alcohol components include polyhydric alcohols such as glycerin, pentaerythritol, sorbitol, sorbitan, and oxyalkylene ether of novolak type phenol resins. The acid component includes polyvalent carboxylic acids such as trimellitic acid, pyromellitic acid, 1,2,3,4-butanetetracarboxylic acid, and benzophenonetetracarboxylic acid, and anhydrides thereof.

Preferably the above polyester resin contains 45 to 55% by molar mass of alcohol component and 55 to 45% by molar mass of acid component in the total components.

In the present invention, as far as the physical property of the obtained toner particles is not adversely affected, two or more polyester resins may be simultaneously used, or for example, it is also favorable to adjust the physical property of a polyester resin by modifying the resin with a compound having a silicone or fluroalkyl group.

In addition, in the case of using such a high molecular polymer containing a polar functional group, an average molecular thereof is preferably 5,000 or more.

Further, resins other than those described above maybe added to the polymerizable monomer system. Examples of the resins used include: homopolymers of styrene and substituents thereof such as polystyrene and polyvinyltoluene; styrene copolymers such as a styrene/propylene copolymer, a styrene/vinyltoluene copolymer, a styrene/vinylnaphthalene copolymer, a styrene/methyl acrylate copolymer, a styrene/ethyl acrylate copolymer, a styrene/butyl acrylate copolymer, a styrene/octyl acrylate copolymer, a styrene/dimethylaminoethyl acrylate copolymer, a styrene/methyl methacrylate copolymer, a styrene/ethyl methacrylate copolymer, a styrene/butyl methacrylate copolymer, a styrene/dimethylaminoethyl methacrylate copolymer, a styrene/vinyl methyl ether copolymer, a styrene/vinyl ethyl ether copolymer, a styrene/vinyl methyl ketone copolymer, a styrene/butadiene copolymer, a styrene/isoprene copolymer, a styrene/maleic acid copolymer, and a styrene/maleate copolymer; polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosins, modified rosins, terpene resins, phenol resins, aliphatic or alicyclic hydrocarbon resins, aromatic petroleum resins; and the like. Those resins may be used singly or as a mixture.

The addition amount of the above resin is preferably 1 to 20 parts by mass with respect to 100 parts by mass of polymerizable monomer. If it is less than 1 part by mass, the effect of the addition is small. On the other hand, if it is more than 20 parts by mass, it may be difficult to design the physical property of the polymerized toner.

Futhermore, it is possible to dissolve a polymer into the polymerizable monomer, the polymer having a molecular weight which is different from the molecular weight range of the toner particle obtained by polymerizing the polymerizable monomer.

A preferable polymerization initiator to be used in the present invention is one having a half life of 0.5 to 30 hours to be used in an addition amount of 0.5 to 20 parts by mass with respect to 100 parts by mass of polymerizable monomer at the time of a polymerization reaction. When the polymerization reaction is performed using such a polymerization initiator, a polymer having the maximum in molecular weights ranging from 10,000 to 100,000 can be obtained to provide the toner with a favorable strength and appropriate melting characteristics. The polymerization inhibitor may be, for example, an azo or diazo polymerization inhibitor such as 2,2'-azobis-(2,4-dimethylvaleronitrile), 2,2'-azobis isobutyronitrile, 1,1'-azobis (cylohexane-1-carbonitrile), 2,2'-azobis-4-methoxy-2,4-dimethylvaleronitrile, or azobis isobutyronitrile; or a peroxide polymerization inhibitor such as benzoyl peroxide, methylethylketone peroxide, diisopropyl peroxycarbonate, cumene hydroperoxide, 2-4-dichlorobenzoyl peroxide, lauroyl peroxide, or t-butylperoxy-2-ethylhexanoate.

When the toner particles are to be produced in the present invention, a crosslinking agent may be added. A preferable addition amount of the crosslinking agent is in the range of 0.001 to 15 parts by mass with respect to 100 parts by mass of the polymerizable monomer.

Here, as the crosslinking agent, a compound that has two or more polymerizable double bonds is mainly used. Examples of such crosslinking agents include: aromatic divinyl compounds such as divinylbenzene and divinyl naphthalene; carboxylates having two double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; compounds having three or more vinyl groups; and the like. Those crosslinking agents may be used singly or as a mixture.

In the present invention, a seed polymerization process can be favorably used. In the seed polymerization, polymerizable monomer is further absorbed onto the obtained toner particles, followed by polymerization using the polymerization initiator. At this time, the process may be also used such that a polar compound is dispersed or dissolved in the polymerizable monomer to be adsorbed.

According to the process for producing toner particles of the present invention, in the suspension polymerization, the above-mentioned toner composition, i.e., components essential to toner particles such as pigment, releasing agent, plasticizer, charging-control agent, and crosslinking agent, and other additives such as organic solvent for lowering the viscosity of a polymer that is generated in the polymerization reaction, high molecular polymer, or dispersant are added as appropriate in a polymerizable monomer and are then uniformly dissolved or dispersed therein to provide a polymerizable monomer system, followed by suspending it in an aqueous medium containing a dispersion stabilizing agent. At this time, for obtaining a narrow particle size distribution of toner particles, it is preferable to form desired size of the toner particles at once by a high speed dispenser such as an ultrasonic disperser or a high speed stirrer. As for the timing for adding a polymerization inhibitor, it may be simultaneously added at the time of adding other additives into the polymerizable monomer, or may be mixed in directly before suspension into the aqueous medium. In addition, the polymerization inhibitor may be added during granulation or immediately after the granulation, or before initiating the polymerization reaction, in a state of being dissolved in the polymerizable monomer or solvent.

After the granulation, the state of particles are kept using a normal stirrer while performing stirring that is enough to prevent the particles from becoming floated or precipitated.

In the process for producing toner particles of the present invention, as a dispersion stabilizing agent, the well known surfactant or organic or inorganic dispersant can be used. Of those, the inorganic dispersant hardly generates harmful ultra-fine particles. In addition, because of dispersion stability obtained by its steric hindrance property, the stability is hardly decreased even though the reaction temperature is changed. In addition, it is easy to wash the above dispersant therefore while no undesired effects hardly occur in the toner particles. Therefore, it can be favorably used. The examples of such an inorganic dispersant include multivalent metallic phosphates such as calcium phosphate, magnesium phosphate, aluminum phosphate, and zinc phosphate, carbonates such as calcium carbonate and magnesium carbonate, inorganic salts such as calcium metasilicate, calcium sulfate, and barium sulfate, and inorganic oxides such as calcium hydroxide, magnesium hydroxide, aluminum hydroxide, silica, bentonite, and alumina.

These inorganic dispersants may be preferably used independently at an amount of 0.2 to 20 parts by mass with respect to 100 parts by mass of polymerizable monomer. However, it is difficult to generate ultra-fine particles and is not adequate to make fine particles of toner to a certain extent, so that 0.001 to 0.1 part by mass of surfactant may be simultaneously used.

The surfactants include, for example, sodium dodecyl benzene sulfate, sodium tetradecyl sulfate, sodium pentadecyl sulfate, sodium octyl sulfate, sodium oleate, sodiumlaurate, sodium stearate, and potassium stearate.

In the case of using the inorganic dispersant, it may be used as it is. Alternatively, it may be used after forming the inorganic dispersant particles in the aqueous medium in order to obtain the finer particles. For instance, in the case of calcium phosphate, a sodium phosphate aqueous solution and a calcium chloride aqueous solution are mixed under high speed stirring to generate water-insoluble calcium phosphate. As result, it becomes possible to obtain inorganic dispersant which includes more uniform and finer particles. At this time, water-soluble sodium chloride is simultaneously obtained as a by-product. However, when the water-soluble salt is present in the aqueous medium, the solubility of polymerizable monomer to water is suppressed. Thus, it is more preferable because ultra-fine particles of toner by emulsion polymerization are difficult to generate.

The above water-soluble salt becomes a barrier at the time of removing the remaining polymerizable monomer at the final stage of the polymerization reaction, so that it is preferable to exchange the aqueous medium or desalt it with an ion exchange resin. The inorganic dispersant can be almost completely removed by dissolution with acid or alkali after completing the polymerization.

In the above polymerization process, the polymerization is performed by adjusting the polymerization temperature to 40° C. or more, typically in the range of 50 to 90° C. When the polymerization is performed within such a temperature range, a releasing agent, wax, or the like to be sealed in the interior of toner particles is precipitated by phase separation, so that the capsulation can be more completely attained. For consuming the remaining polymerizable monomer, it is possible to increase the reaction temperature up to 90 to 150° C. at the final stage of the polymerization reaction.

After completing the polymerization, the polymerized toner particles are filtered, washed, and dried by the well-known process. The inorganic fine powder is mixed with the resulting toner particles to adhere the inorganic fine powder on the surface of the respective toner particles, resulting in the final product of toner. In addition, one of the preferred embodiments of the present invention is an embodiment which includes the classifying step for removing coarse particles and fine particles from the toner particles. As a preferable embodiment, inorganic fine powder having a number average primary particle size of 4 to 80 nm may be added as a fluidizing agent in the toner particles produced by the process for producing toner particles of the present invention.

The inorganic fine powder to be used in the toner particles produced by the process for producing toner particles of the present invention may be silica, alumina, titanium oxide, or the like. For instance, each of the so-called dry-process or fumed silica generated by vapor phase oxidation of silicon halogenide and the so-called wet silica produced from water glass or the like can be used as silicate fine powder. However, the dry silica is preferable because the number of silanol groups on the surface and the inside of silica fine powder and the residual products such as $Na_2O$ and $SO_3^{2-}$ of the producing process are smaller than those of the wet silica. Further, for the dry silica it is also possible to use a complex fine powder of silica and other metallic oxide using silicon halide together with other metallic halide such as aluminum chloride or titanium chloride in a preparation process therefor. The dry silica may include them.

The addition amount of inorganic fine particles having an average primary particle size of 4 to 80 nm may be preferably in the range of 0.1 to 3.0% by mass with respect to the toner particles. If it is less than 0.1% by mass, the resulting effect is insufficient. If it is more than 3.0% or mass, the fixing property may be decreased.

Further, the content of the inorganic fine powder can be determined using a calibration curve obtained from the standard sample using a fluorescent X-ray analysis.

Preferable inorganic fine powder is one provided with hydrophobic property because of its characteristics under high-temperature and high-humidity environment.

The processing agents for providing the powder with hydrophobic property include silicone varnish, various kinds of modified silicone varnish, silicone oil, various kinds of modified silicone oil, silane compound, silane coupling agent, other organic silicone compound, organic titanium compound, and so on. These processing agents can be used independently or in combination. As a process for processing inorganic fine powder, for example, there is a process in which a first-stage reaction where a silylation reaction is performed to remove silanol groups by chemical bonding and a second-stage reaction where a hydrophobic thin film is formed on the surface of powder by silicone oil are included.

The above silicone oil may have a preferable viscosity of 10 to 200,000 $mm^2$/sec. at 25° C., more preferably 3,000 to 80,000 $mm^2$/sec. If the viscosity is less than 10 $mm^2$/sec., there is no stability of the inorganic fine powder and the image quality tends to be deteriorated by thermal and mechanical stresses. If it is more than 200,000 $mm^2$/sec., uniform processing tends to be difficult.

A particularly preferable silicone oil to be used may be, for example, dimethyl silicone oil, methylphenyl silicone oil, α-methylstyrene-modified silicone oil, chlorophenyl silicone oil, or fluorine-modified silicone oil.

As a process for silicone oil treatment, for example, silicone oil and silica treated with silane compound may be directly mixed in a mixer such as a HENSCHEL MIXER, or silicone oil may be sprayed on silica. Alternatively, silicone oil may be dissolved or dispersed in an appropriate solvent and then silica fine powder may be added and mixed, followed by removing the solvent. It is more preferable to use a spray because of a comparatively small amount of the aggregate of inorganic fine powder to be generated.

The processing amount of the silicone oil is preferably in the range of 1 to 40 parts by mass, more preferably 3 to 35 parts by mass with respect to 100 parts by mass of silica.

The silica to be used in the present invention preferably has a specific surface area of 20 to 350 $m^2$/g, more preferably 25 to 300 $m^2$/g, which is measured by the BET process using nitrogen adsorption, to provide the toner favorable flowabilities.

According to the BET process, the specific surface area can be obtained by making nitrogen gas adsorb on a sample surface to calculate the specific surface area thereof using a specific surface area analyzer, AUTOSORB-1 (manufactured by Yuasa Ionics Co., Ltd.) by using the BET multi-point process.

In addition, as another preferable embodiment of the toner particles produced by the process for producing toner particles of the present invention for the purpose of increasing the cleaning property or the like, inorganic or organic fine particles with the substantially spherical shape having a primary particle size of more than 30 nm (preferably, a specific surface area of less than 50 $m^2$/g), more preferably a primary particle size of 50 nm or more (preferably, a specific surface area of less than 30 $m^2$/g) may be added. For example, spherical silica particles, spherical polymethyl silsesguioxane particles, spherical resin particles, and so on are preferably used.

The toner particles produced by the process for producing toner particles of the present invention may further include, as far as any adverse effect is substantially caused, other additives, for example, lubricant powders such as polyfluoroethylene powder, zinc stearate powder, or polyfluorovinylidene powder, abrasives such as ceric oxide powder, silicon carbide powder, or strontium titanate powder, fluidity-providing agent such as titanium oxide powder or aluminum oxide powder, caking preventing agent, or organic fine particles having reverse polarity, and in addition, a small amount of inorganic fine particles as a development improver. Further, the surfaces of these additives may be provided with hydrophobic property to be used.

Toner including toner particles produced by the process for producing toner particles of the present invention may be used as one-component developer. For example, in the case of polymerized toner in which the magnetic substance is included in toner as one-component developer, a magnet incorporated in a developing sleeve is used to enable the transfer and charging of polymerized toner. However, the toner including the toner particles of the present invention is not limited to the above one-component developer. Alternatively, it may be a two-component developer.

In the case of using it as the two-component developer, magnetic carrier is used together with the toner described above for the use of a developer. The magnetic carrier is composed of one element or two or more elements selected from the group consisting of iron, copper, zinc, nickel, cobalt, manganese, and chrome elements in a state of complex ferrite. The shape of the magnetic carrier is spherical, flat, or infinite form. Further, it is preferable to control the microstructure of the surface condition (i.e., the surface irregularity) of the magnetic carrier particle. In the process generally used, the above inorganic oxide is baked and granulated in advance to generate magnetic carrier core particles, and then the particles are applied on the resin. For generating magnetic carrier particles, it is possible to utilize the process in which the inorganic oxide and the resin are kneaded and the resulting mixture is then pulverized and classified to obtain a low-density dispersion carrier for reducing the load to the toner of magnetic carrier particles, or the process in which the kneaded product of the inorganic oxide and the monomer is directly subjected to suspension polymerization in the aqueous medium to obtain spherical magnetic carrier particles.

Coated carrier in which the surfaces of above magnetic carrier particles are coated with resin is particularly preferable. As the applicable process for coating the resin on these particles, the resin is dissolved or suspended in a solvent and is then applied on the particles so as to be adhered on the magnetic carrier particles. Alternatively, the resin powder and the carrier particles are simply mixed to allow the mixture to adhere thereon.

Different kinds of substances to be fixedly adhered on the surface of the carrier particle are used depending on the toner materials. For instance, examples thereof include polytetrafluoroethylene, monochlorotrifluoroethylene polymer, poly (vinylidene fluoride), silicone resin, polyester resin, styrene resin, acryl resin, polyamide, polyvinyl butyral, and amino acrylate resin. They may be used independently or in combination.

Preferable magnetic characteristics of the magnetic carrier are as follows. That is, it is preferable to have a magnetization intensity ($\sigma 1000$) of 3.77 to 37.7 $\mu Wb/cm^3$ under a magnetic field intensity of 79.6 kA/m after magnetic saturation. In addition, for attaining a high image quality, the magnetization intensity may be preferably in the range of 12.6 to 31.4 $\mu Wb/cm^3$. If it is more than 37.7 $\mu Wb/cm^3$ it becomes difficult to obtain a high quality toner image. If it is less than 3.77 $\mu Wb/cm^3$, the carrier adhesion tends to occur as the magnetic constrain force decreases.

In the case of preparing a two-component developer by mixing the toner including toner particles produced by the process for producing toner particles of the present invention and the magnetic carrier, typically a good result can be obtained when the mixing ratio thereof is 2 to 15% by mass, preferably 4 to 13% by mass on the basis of the concentration of the toner in the developer.

Hereinafter, a description will be made of measuring processes to be used in the present invention.

(1) The Measurement of Particle Size Distribution and the Computation of Number Variation Coefficient The average particle size and particle size distribution of toner can be measured by various kinds of methods including those using a COULTER COUNTER TA-II, a COULTER MIULTISIZER (manufactured by Coulter Co., Ltd.), or the like. In the present invention, the COULTER MULTISIZER (manufactured by Coulter Co., Ltd.) is used, and the COLTLTER MULTISIZER is connected to an interface (manufactured by Nikkaki Co., Ltd.) and a personal computer (PC9801, manufactured by NEC Corporation) for outputting number distribution and volume distribution for measurement. An electrolytic solution used in this measurement is a 1% NaCl aqueous solution prepared using first-class sodium chloride. For instance, ISOTON R-II (Coulter Scientific Japan Co., Ltd.) can be used as the electrolytic solution.

As the measurement method, a surfactant, preferably 0.1 to 5 ml of alkyl benzene sulfonate is added as a dispersant in 100 to 150 ml of the electrolytic solution, and then 2 to 20 mg of a measurement sample is added in the electrolytic solution. The sample-suspended electrolytic solution is subject to a dispersion treatment for about 1 to 3 minutes using an ultrasonic disperser, followed by measuring the volume and number of toner particles having a particle size of 2 $\mu m$ or more using 100 $\mu m$ aperture as an aperture by the COULTER MULTISIZER to calculate the volume distribution and the number distribution.

A number variation coefficient is obtained from a weight average particle size (D4: the median of each channel is defined as a representative value of the channel) obtained from the volume distribution and a length average particle size (D1) obtained from the number distribution of the present invention. In other words, the number variation coefficient is represented by the equation:

$$\text{Number variation coefficient } (\%) = [S/D1] \times 100$$

wherein S denotes a standard deviation in the volume distribution of toner particles and D1 denotes the number average particle size ($\mu m$) of toner particles. That is, the smaller the value of the variation coefficient, the narrower the particle size distribution range of the toner particles. On the other hand, the larger the value of the variation coefficient, the broader the particle size distribution range of the toner particles.

(2) Measurement Method of THF-Insoluble Resin Component

The THF-insoluble resin component is measured as a mass ratio of an ultrahigh-molecular polymer component (substantially cross-linked polymer) with respect with the toner particles. The ultrahigh-molecular polymer component is a resin which is in the toner particles and insoluble to THF solvent. In addition, the THF-insoluble resin component is defined by the value measured as follows.

About 1.0 g of a toner sample is weighed (W1 g) and is then placed in an extraction thimble (e.g., No. 86R, manufactured by Toyo Roshi Co., Ltd.), followed by subjecting it to a Soxhlet extractor using 100 to 200 ml of THF as a solvent. The extraction is performed for 16 hours. Subsequently, the soluble component extracted by the THF solvent is evaporated, followed by drying under vacuum at 100° C. for several hours. Then, the quantity of the THF-soluble resin component is weighed (W2g). In addition, the mass of components insoluble to THF such as pigment in the toner is obtained (W3g). The THF-insoluble resin component is obtained from the following equation.

$$THF\text{-insoluble resin component } (\%) = \{W1-(W3+W2)\}/(W1-W3) \times 100$$

EXAMPLES

Hereinafter, the present invention will be described in more detail with reference to examples. However, the present invention is not limited to those examples.

Producing Example of Surface-Processed Magnetic Substance (1)

An aqueous solution containing iron hydroxide was prepared by adding and mixing 1.0 to 1.1 equivalent weight of a sodium hydroxide solution with respect to iron element in a ferrous sulfate aqueous solution.

The air was blown into the aqueous solution while keeping the pH of the aqueous solution at about 9, and then an oxidation reaction was performed at 80 to 90° C. to prepare a slurry liquid that generates a seed crystal. Subsequently, a ferrous sulfate insoluble solution is added in the slurry liquid so as to attain an equivalent weight of 0.9 to 1.2 with respect to the original amount of alkali (sodium content of sodium hydroxide). After that, the air was brown into the slurry liquid while keeping the pH at 8, and then an oxidation reaction was performed at 80 to 90° C. to prepare a slurry liquid of magnetic particles, followed by washing and filtration. Subsequently, the water-containing slurry was temporally taken out. At this time, a small amount of a sample of the water-containing slurry was collected and the water content thereof was measured. Next, the water-containing sample was re-dispersed in another aqueous medium without drying. Then, the pH of the re-dispersion liquid was adjusted to about 6. Subsequently, 1.3 parts by mass of γ-methacryloxypropyl trimethoxysilane coupling agent was added with respect to 100parts by mass of magnetic particles (the amount of the magnetic particles was calculated by subtracting the water content from the water-containing sample) while sufficiently stirring the mixture to conduct a coupling processing. The resulting hydrophobic magnetic particles were washed, filtrated, and dried by conventional procedures. The obtained particles were crushed sufficiently, thus obtaining a surface-processed magnetic substance (1) having a volume average particle size of 0.19 μm.

Reference Example 1

[Main Process]

Figure 3:
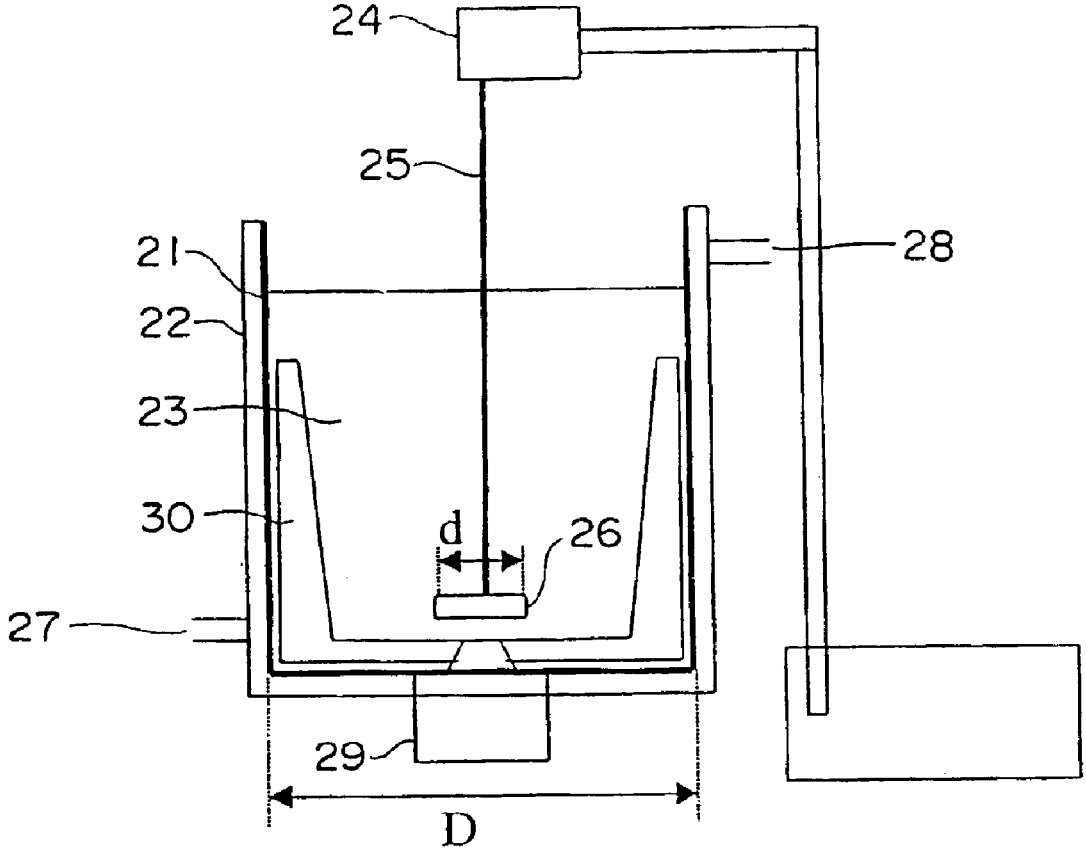
FIG. 3 is a diagram of an example of a dispersing and dissolving apparatus to be used in the present invention.

A stirrer shown in FIG. 3 was used for dispersing and dissolving raw materials for producing toner particles. Then, the toner particles were produced by the flow of the main process shown in FIG. 1.

| | |
|---|---|
| Styrene: | 80 parts by mass |
| T-77 (manufactured by Hodogaya Kagaku Kogyo Co., Ltd.): | 1 part by mass |
| N-butylacrylate: | 20 parts by mass |
| Terephthalic acid-propyleneoxide modified bisphenol A (acid value 10 mgKOH/g m.w. 7500): | 5 parts by mass |
| Surface-processed magnetic substance (1) : | 80 parts by mass |
| Divinylbenzene: | 0.3 parts by mass |

Figure 6:
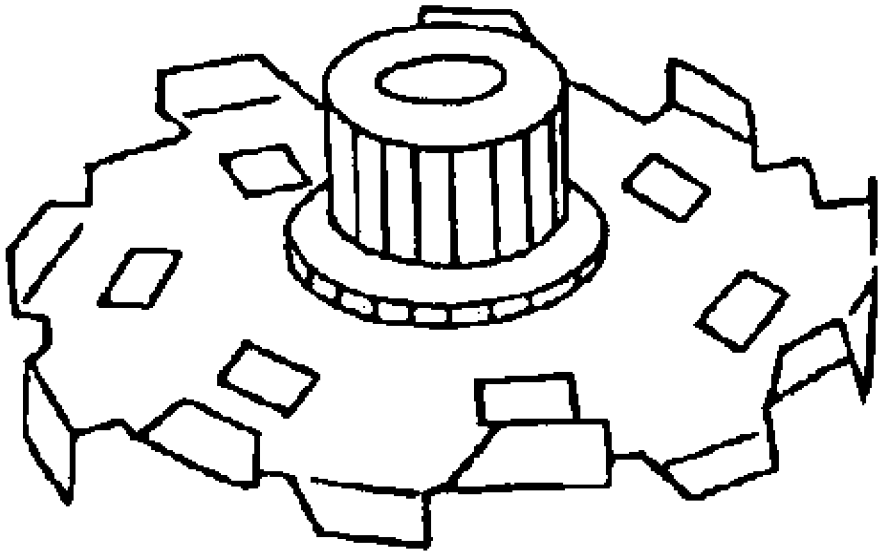
FIG. 6 is a view of an example of an edged turbine blade to be used in the present invention.

The above formulation was added into a process tank 22, followed by introducing hot water into a process tank jacket 21 through a hot water/cold water inlet 27 while discharging the hot water from an outlet 28 to the outside. Thus, the temperature of a processing substance 23 was gradually increased up to about 60° C. over 30 minutes while actuating a motor 24 to rotate a stirring shaft 25 at a rate of about 36.7 rps and actuating a motor 29 to rotate an anchor blade 30 at a rate of about 1.5 rps, thereby initiating the dispersion of pigments. In addition, a stirring blade 26 used was an edged turbine blade shown in FIG. 6, while the processing tank 22 was one having an inner diameter of 600 mm, a stirring-blade diameter of 130 mm and was designed to have d/D =0.22. At this time, the peripheral speed of the stirring blade 26 was about 15 m/sec.

When the processing substance reached 60° C., 10 parts by mass of the ester wax ((maximum value of heat-absorption peak of DSC: 72° C.) was added. Then, the operation was continued. After a lapse of 90 minutes, 3 parts by mass of benzoyl peroxide (polymerization initiator) was added. Then, a fine particulate polymerizable monomer mixture was obtained.

On the other hand, 450 parts by mass of 0.1 mol/1 of $Na_3PO_4$ aqueous solution and 16 parts by mass of 1 N HCl were added in 720 parts by mass of ion-exchanged water in a vessel equipped with a high speed stirrer (TK-HOMOMIXER). The revolving speed of the mixer was adjusted to 200 rps and the mixture was heated to 60° C. Then, 68 parts by mass of 1.0 mol/1-$CaCl_2$ aqueous solution was added to prepare a dispersion medium system containing a microscopic particles of a water-insoluble dispersant $Ca_3(PO_4)_2$. A fine-powdery polymerizable monomer mixture heated to 60° C. was introduced into the dispersion medium system heated to 60° C. and was then granulated by a rotary motion of the TK-HOMOMIXER at 240 rps for 15 minutes.

Subsequently, a stirrer was changed from the high speed stirrer to a stirrer having a propeller stirring blade. Then, the temperature of the mixture was elevated to 80° C. and the reaction was performed for 8 hours. After completing the polymerization, the slurry was partially sampled in a small amount, and then the number variation coefficient was calculated from the measured particle size distribution. The smaller the value means the narrower the particle size distribution. Further, the toner particles in the slurry were observed with an optical microscope. From the observation, it was found that there was no white ball and the pigments were dispersed uniformly in the toner particles. The results are shown in Table 1.

After completing the polymerization reaction, the remaining monomers were removed under reduced pressure. After cooling, dilute hydrochloric acid was added to dissolve the dispersant. Then, the solid/liquid separation, washing, filtration, drying, and classifying were performed to obtain polymerized toner particles. After classifying, fine particles and coarse particles having non-desired particle sizes were subjected to the measurements of their particle size distributions using a COULTER MULTISIZER. As a result, the average particle sizes of the fine particles and the coarse particles were D4=3.8 μm, and 13.2 μm, respectively. In addition, at the time of completing the polymerization, a small amount of the sample was taken and then was subjected to measurement of particle size distribution with the COULTER MULTISIZER. The results are shown in Table 1.

After that, 100 parts by mass of the polymerized toner and 1.0 parts by mass of hydrophobic silica fine particles (having a BET value of 120 $m^2/g$ after the treatment in which silica of 12 nm in primary particle size was treated with hexamethyl disilazane and then treated with silicone oil were mixed by HENSCHEL mixer (manufactured by Mitsui Miike Kagaku Kogyo Co., Ltd.) to prepare a developer.

Using this developer, an image formation was performed by a printer LBP 1760 (manufactured by Canon Inc.) under the conditions of 15° C./10%, followed by subjecting the resulting image to the measurement of image density. The image density was measured such that a solid image portion was formed and then the image density of the solid portion was measured using a MACBETH REFLECTION DENSITOMETER (manufactured by Macbeth Co., Ltd.). The results are shown in Teble 1.

[Recycling Process]

Hereinafter, a description will be given of the process for recycling the resin composition including non-desired toner particles such as fine particles and coarse particles after the classification, ultra-fine particles adhered on a blower of the classifying apparatus, and deposits on the wall surface of the vessel after the reaction.

Mixture I Other than the Desired Toner Particles

Fine particles, coarse particles, and bag fine particles generated as by-products in the process classification were uniformly mixed using a HENSCHEL MIXER to obtain a mixture I other than the desired toner particles. The THF-insoluble resin component of the mixture I other than the desired toner particles was measured. As a result, the amount thereof was 73% by mass.

Powder I of Kneaded Material

Subsequently, the mixture I other than the desired toner particles was kneaded repeatedly by a screw kneader to apply a shearing force to the THF-insoluble resin component. The molecular chain of the THF-insoluble resin component was cut off to make it into lower molecule. Further, at this time, the temperature of the processing substance was kept at 100° C. and kneaded. After that, the processing substance was crushed with a speed mill to obtain the powder I of the kneaded material. The THF-insoluble resin component of the powder I of the kneaded material was subjected to the measurement. As a result, the content thereof was 16% by mass.

Mixture II Other than the Desired Toner Particles

The deposits on the wall face of the vessel were pulverized with a hammer mill to change it into fine particles to prepare scale fine particles. Subsequently, fine particles, coarse particles, bag fine particles, and scale powder were uniformly mixed using a HENSCHEL MIXER to obtain the mixture II other than the desired toner particles. The THF-insoluble resin component of the mixture II other than the desired toner particles was subjected to the measurement. As a result, the content thereof was 88% by mass.

Powder II of Kneaded Material

Subsequently, the mixture II other than the desired toner particles was kneaded repeatedly by a screw kneader to apply a shearing force to the THF-insoluble resin component. The molecular chain of the THF-insoluble resin component was cut to make it into lower molecule. Further, at this time, the temperature of the processing substance was kept at 100° C. and kneaded. After that, the processing substance was crushed with a speed mill to obtain the powder II of the kneaded material. The THF-insoluble resin component of the powder II of the kneaded material was subjected to the measurement. As a result, the content thereof was 25% by mass.

Example 1

The same procedures as those of Reference Example 1 were performed except that raw materials for generating toner particles, the amount of ester wax to be used, and the amount of polymerization initiator were changed as described below. 10% by mass of 200 parts by mass of the raw materials of toner in Reference Example 1 was changed to the powder I of the kneaded material. The values of physical properties of toner are shown in Table 1.

| Raw materials for the generation of toner particles | |
|---|---|
| Powder I of kneaded material: | 20 parts by mass (10% by mass with respect to toner raw material) |
| Styrene: | 80 × 0.9 parts by mass |
| T-77 (manufactured by Hodogaya Kagaku Kogyo Co., Ltd.) | 1 × 0.9 parts by mass |
| N-butylacrylate: | 20 × 0.9 parts by mass |
| Terephthalic acid-propyleneoxide modified bisphenol A (acid value 10 mgKOH/g m.w. 7500): | 5 × 0.9 parts by mass |
| Surface-processed magnetic substance (1): | 80 × 0.9 parts by mass |
| Divinylbenzene: | 0.3 × 0.9 parts by mass |
| Ester wax to be added | |
| Ester wax (maximum value of heat-absorption peak of DSC: 72° C.): | 10 × 0.9 parts by mass |
| Polymerization initiator to be added | |
| Benzoyl peroxide: | 3 × 0.9 parts by mass |

Example 2

The same procedures as those of Reference Example 1 were performed execept that raw materials for generation toner particles, the amount of ester wax, and the amount of polymerization initiator were changed as described below. With respect to 200 parts by mass of the raw material of toner obtained in Reference Example 1, a 20% by mass portion was changed to the powder I of the kneaded material. The values of physical properties of toner are shown in Table 1.

| Raw materials for the generation of toner particles | |
|---|---|
| Powder I of kneaded material: | 40 parts by mass (20% by mass with respect to toner raw material) |
| Styrene: | 80 × 0.8 parts by mass |
| T-77 (manufactured by Hodogaya Kagaku Kogyo Co., Ltd.): | 1 × 0.8 parts by mass |
| N-butylacrylate: | 20 × 0.8 parts by mass |
| Terephthalic acid-propyleneoxide modified bisphenol A (acid value 10 mgKOH/g m.w. 7500): | 5 × 0.8 parts by mass |
| Surface-processed magnetic substance (1): | 80 × 0.8 parts by mass |
| Divinylbenzene: | 0.3 × 0.8 parts by mass |
| Ester wax to be added | |
| Ester wax (maximum value of heat-absorption peak of DSC: 72° C.) | 10 × 0.8 parts by mass |
| Polymerization initiator to be added | |
| Benzoyl peroxide: | 3 × 0.8 parts by mass |

Example 3

The same procedures as those of Reference Example 1 were performed except that raw materials for generating toner particles, the amount of ester was, and the amount of polymerization initiator were changed as described below. With respect to 200 parts by mass of the raw materials of toner obtained in Reference Example 1, a 30% by mass portion was changed to the power I of the kneaded material. The values of physical properties of toner are shown in Table 1.

| Raw materials for the generation of toner particles | |
|---|---|
| Powder I of kneaded material: | 60 parts by mass (30% by mass with respect to toner raw material) |
| Styrene: | 80 × 0.7 parts by mass |
| T-77 (manufactured by Hodogaya Kagaku Kogyo Co., Ltd.): | 1 × 0.7 parts by mass |
| N-butylacrylate | 20 × 0.7 parts by mass |
| Terephthalic acid-propyleneoxide modified bisphenol A (acid value 10 mgKOH/g m.w. 7500): | 5 × 0.7 parts by mass |
| Surface-processed magnetic substance (1): | 80 × 0.7 parts by mass |
| Divinylbenzene: | 0.3 × 0.7 parts by mass |
| Ester wax to be added | |
| Ester wax (maximum value of heat-absorption peak of DSC: 72° C.) | 10 × 0.7 parts by mass |
| Polymerization initiator to be added | |
| Benzoyl peroxide: | 3 × 0.7 parts by mass |

Example 4

The same procedures as those of Reference Example 1 were performed except that raw materials for generating toner particles, the amount of ester wax, and the amount of polymerization initiator were changed as described below. With respect to 200 parts by mass of the raw materials of toner obtained in Reference Example 1, a 40% by mass portion was changed to the powder I of the kneaded product. The values of physical properties of toner are shown in Table 1.

| Raw materials for the generation of toner particles | |
|---|---|
| Powder I of kneaded product: | 80 parts by mass (40% by mass with respect to toner raw material) |
| Styrene: | 80 × 0.6 parts by mass |
| T-77 (manufactured by Hodogaya Kagaku Kogyo Co., Ltd.): | 1 × 0.6 parts by mass |
| N-butylacrylate: | 20 × 0.6 parts by mass |
| Terephthalic acid-propyleneoxide modified bisphenol A (acid value 10 mgKOH/g m.w. 7500): | 5 × 0.6 parts by mass |
| Surface-processed magnetic substance (1): | 80 × 0.6 parts by mass |
| Divinylbenzene: | 0.3 × 0.6 parts by mass |
| Ester wax to be added | |
| Ester wax (maximum value of heat-absorption peak of DSC: 72° C.) | 10 × 0.6 parts by mass |
| Polymerization initiator to be added | |
| Benzoyl peroxide: | 3 × 0.6 parts by mass |

Example 5

The same procedures as those of Reference Example 1 were performed except that raw materials for generating toner particles, the step of dispersing and the step of dissolving the amount of were changed as described below. A With respect to 200 parts by mass of the raw materials of toner obtained in Reference Example 1, a 10% by mass portion was chanted to the powder I of the kneaded material.

| Raw materials for the generation of toner particles | |
|---|---|
| Powder I of kneaded material: | 20 parts by mass (10% by mass with respect to toner raw material) |
| Styrene: | 80 × 0.9 parts by mass |
| T-77 (manufactured by Hodogaya Kagaku Kogyo Co., Ltd.) | 1 × 0.9 parts by mass |
| N-butylacrylate: | 20 × 0.9 parts by mass |
| Terephthalic acid-propyleneoxide modified bisphenol A (acid value10 mgKOH/g m.w. 7500): | 5 × 0.9 parts by mass |
| Surface-processed magnetic substance (1): | 80 × 0.9 parts by mass |
| Divinylbenzene | 0.3 × 0.9 parts by mass |

Figure 4:
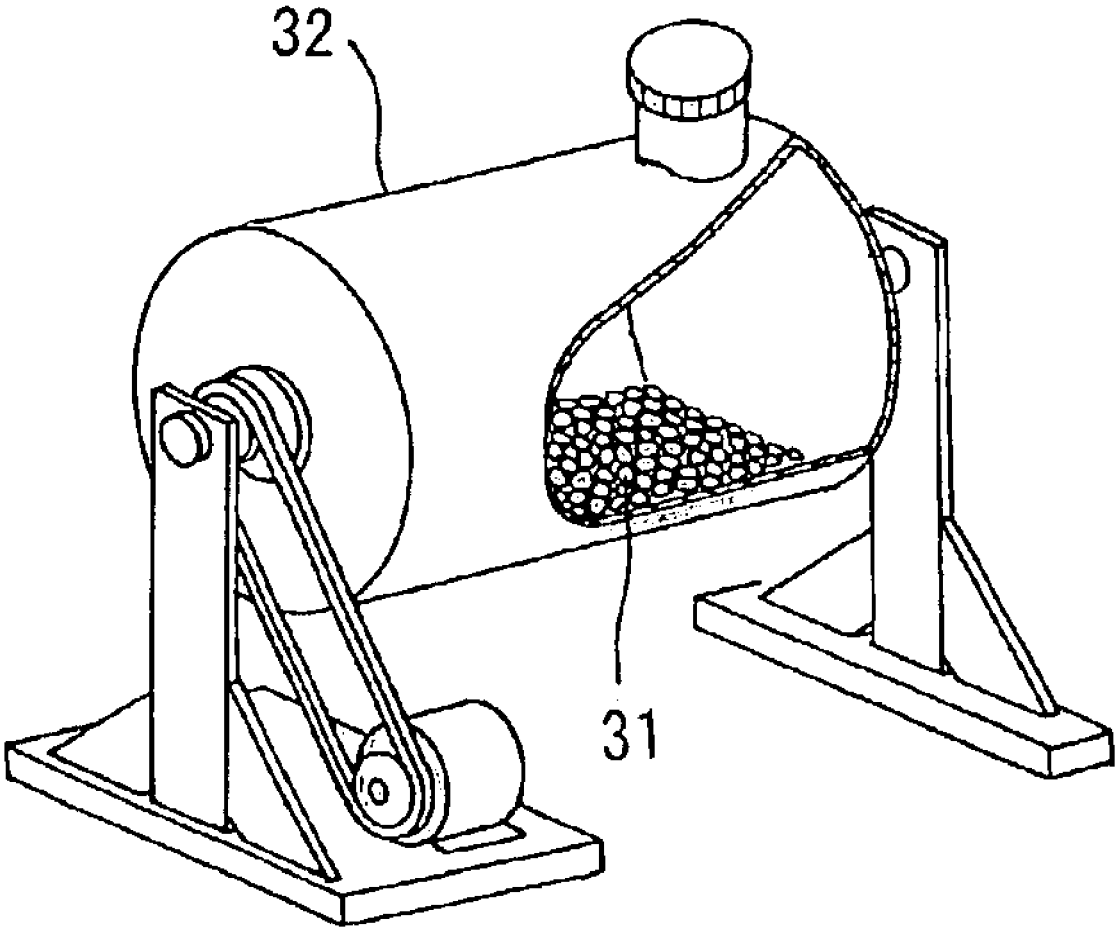
FIG. 4 is a view of an example of a media mill dispersing apparatus to be used in the present invention.
Figure 5:
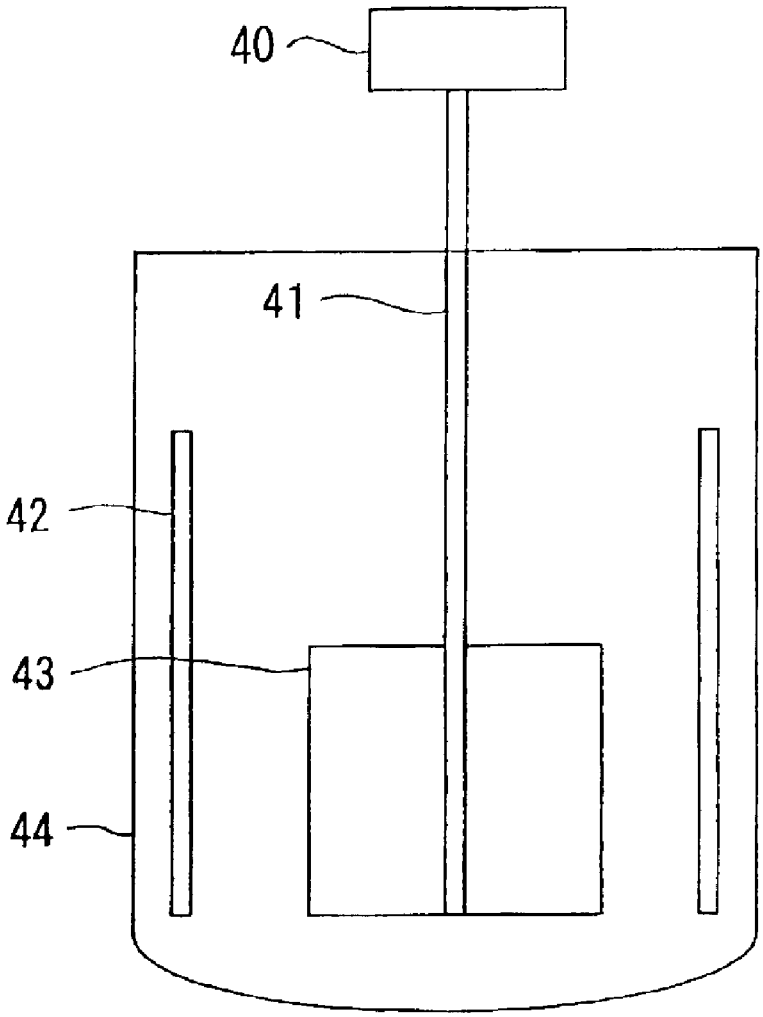
FIG. 5 is a diagram of a dissolving apparatus to be used in the present invention.

20 kg of media particles 31 (made with Zirconia) having a diameter of 1 mm were filled in a media type dispersion apparatus (a loading weight of 55% by mass) shown in FIG. 4, followed by charging the above raw materials into the process tank 32. Then, the process tank 32 was stirred at a peripheral speed of 1.5 m/s for 3 hours under atmospheric pressure to disperse the mixture. The resultant is transferred to a dissolution device having a paddle as the stirring blade 43 as shown in FIG. 5. The temperature of the mixture was elevated up to 60° C. over 30 minutes. Then, the motor 40 was actuated to start stirring by means of the stirring blade 43 at a rate of 1.5 rps.

When the processing substance temperature has reached 60° C., 10×0.9 parts by mass of the ester wax ((maximum value of heat-absorption peak of DSC: 72° C.) was added. Then, the operation was continued. After the elapse of 90 minutes, 3×0.9 parts by mass of benzoyl peroxide (polymerization initiator) was added to obtain a polymerizable monomer mixture in the form of fine particles. The subsequent steps were performed by the same procedures as those of Reference Example 1. The values of physical properties of toner are shown in Table 1.

Example 6

The same procedures as those of Reference Example 1 were performed except that raw materials for generating toner particles, the amount of ester wax, and the amount of polymerization initiator were changed as described below. With respect to 200 parts by mass of the raw materials of toner obtained in Reference Example 1, a 10% by mass portion was changed to the powder II of the kneaded material. The values of physical properties of toner are shown in Table 1.

| Raw materials for the generation of toner particles | |
|---|---|
| Powder II of kneaded material: | 20 parts by mass (10% by mass with respect to toner raw material) |
| Styrene: | 80 × 0.9 parts by mass |
| T-77 (manufactured by Hodogaya Kagaku Kogyo Co., Ltd.): | 1 × 0.9 parts by mass |
| N-butylacrylate: | 20 × 0.9 parts by mass |
| Terephthalic acid-propyleneoxide modified bisphenol A (acid value 10 mgKOH/g m.w. 7500): | 5 × 0.9 parts by mass |
| Surface-processed magnetic substance (1): | 80 × 0.9 parts by mass |
| Divinylbenzene: | 0.3 × 0.9 parts by mass |
| Ester wax to be added | |
| Ester wax (maximum value of heat-absorption peak of DSC: 72° C.) | 10 × 0.9 parts by mass |
| Polymerization initiator to be added | |
| Benzoyl peroxide: | 3 × 0.9 parts by mass |

Comparative Example 1

The same procedures as those of Reference Example 1 were performed except that raw materials for generating toner particles, the amount of ester wax, and amount of polymerization initiator were changed as described below. With respect to 200 parts by mass of the raw materials of toner obtained in Reference Example 1, a 10% by mass portion was changed to the mixture I (non-kneaded material). The values of physical properties of toner are shown in Table 1.

| Raw materials for the generation of toner particles | |
|---|---|
| Mixture I other than prescribed toner particles: | 20 parts by mass(10% by mass with respect to toner raw material) |
| Styrene: | 80 × 0.9 parts by mass |
| T-77 (manufactured by Hodogaya Kagaku Kogyo Co., Ltd.) | 1 × 0.9 parts by mass |
| N-butylacrylate: | 20 × 0.9 parts by mass |
| Terephthalic acid-propyleneoxide modified bisphenol A (acid value 10 mg KOH/g m.w. 7500): | 5 × 0.9 parts by mass |
| Surface-processed magnetic substance (1): | 80 × 0.9 parts by mass |
| Divinylbenzene: | 0.3 × 0.9 parts by mass |
| Ester wax to be added | |
| Ester wax (maximum value of heat-absorption peak of DSC: 72° C.): | 10 × 0.9 parts by mass |
| Polymerization initiator to be added | |
| Benzoyl peroxide: | 3 × 0.9 parts by mass |

TABLE 1

| | Non-desired toner content | Stirring blade of stirrer | D4 (after classification) | Number variation coefficient | White ball observation | Image density |
|---|---|---|---|---|---|---|
| Reference Example 1 | · | Anchor and edged turbine | 6.88 | A | A | A |
| Example 1 | 10% by mass of kneaded material powder I | Anchor and edged turbine | 6.95 | A | A | A |
| Example 2 | 20% by mass of kneaded material powder I | Anchor and edged turbine | 7.20 | B | B | B |
| Example 3 | 30% by mass of kneaded material powder I | Anchor and edged turbine | 7.32 | B | C | C |
| Example 4 | 40% by mass of kneaded material powder I | Anchor and edged turbine | 7.91 | C | C | C |
| Example 5 | 10% by mass of kneaded material powder I | Paddle | 7.85 | C | C | C |
| Example 6 | 10% by mass of kneaded material powder II | Anchor and edged turbine | 7.23 | A | B | B |
| Comparative Example 1 | 10% by mass of mixture I | Anchor and edged turbine | 8.23 | D | C | D |

· Number variation coefficient
A: less than 28.0%
B: 28.1% or more and less than 32.0%
C: 32.1% or more and less than 36.0%
D: 36.1% or more
· White ball observation (at the time of completing polymerization)
A: no white ball
B: White balls are observed a little
C: White balls are observed, but no practical problem
D: White balls are observed at a practically unfavorable
· Image density
A: 1.4 or more
B: less than 1.4 and 1.2 or more
C: less than 1.2 and 1.0 or more
D: less than 1.0

Reference Example 2

[Main Process]

Toner particles were produced by the flow of main process shown in FIG. 2.

A water dispersion medium and a polymerizable monomer composition were prepared as follows.

Preparation of Water Dispersion Medium

In a vessel equipped with a high speed stirrer (TK HOMOMIXER), the following components were mixed and heated at 60° C., followed by stirring at 200 rps.

| | |
|---|---|
| Water | 950 parts by mass |
| 0.1 mol/1-$Na_3PO_4$ aqueous solution; | 450 parts by mass |

Next, the inside of the vessel was displaced with nitrogen and 68 parts by mass of $CaCl_2$ aqueous solution (1.0 mol/1) was added thereto for a reaction, resulting in a water dispersion medium containing fine particles of calcium phosphate.

| Preparation of polymerizable monomer composition | |
|---|---|
| Styrene: | 145 parts by mass |
| 2-ethylhexyl acrylate | 35 parts by mass |
| E-88 (manufactured by Oriental Chemical Co., Ltd.): | 2 parts by mass |

-continued

| Preparation of polymerizable monomer composition | |
|---|---|
| Terephthalic acid-propyleneoxide modified bisphenol A (acid value 10 mgKOH/g m.w.: 7500): | 20 parts by mass |
| Divinylbenzene: | 0.65 parts by mass |
| Colorant (C.I. pigment blue 15:3): | 14 parts by mass |

20 Kg media particles 31 (made with Zirconia) having a diameter of 1 mm were filled in a media type dispersion apparatus (a loading weight of 55%) shown in FIG. 4, followed by adding the above components into the process tank 32. Then, the process tank 32 was stirred at a peripheral speed of 1.5 m/s for 5 hours under atmospheric pressure to disperse the mixture. Subsequently, it was transferred to a dissolving apparatus shown in FIG. 5 which has a paddle as a stirring blade 43. The temperature of the mixture was elevated up to 60° C. over 30 minutes, while actuating the motor 40 to start stirring by means of the stirring blade 43 at a rate of 1.5 rps. In addition, the dissolving apparatus shown in FIG. 5 comprises a stirring shaft 41, a blocking plate 42, and a tank 44.

When the processing substance reached 60° C., 30 parts by mass of the ester wax (maximum value of heat-absorption peak of DSC: 72° C.) was added. Then, the operation was continued. After the elapse of 90 minutes, a fine particulate polymerizable monomer mixture was obtained. The stirring conditions in the steps of dispersion and dissolution are shown in Table 2.

6 parts by mass of 2,2'-azobis (2,4-dimethylvaleronitnie) was dissolved in 20 parts by mass of styrene and the resulting mixture was gradually added into a vessel containing the water dispersion medium prepared as described above over 20 seconds, while keeping a high speed stirrer (CLEARMIX) at a revolution speed of 250 rps. After 5 minutes elapsed from the completion of the addition of the polymerization initiator, the fine particulate polymerizable monomer mixture prepared as described above was put into the vessel to initiate the granulation. After granulation for 15 minutes, the mixture was transferred into a vessel in a stirrer equipped with a propeller stirring blade while continuing that polymerization at an inner temperature of 65° C. After 6 hours elapsed, the polymerization temperature was elevated to 60° C. and the heat-stirring was continued over 5 hours, followed by completing the polymerization. A part of the slurry after completing the polymerization was collected for sampling and a small amount thereof is sampled. Then, the sample was subjected to the measurement of the particle size distribution and the number variation coefficient was calculated. The smaller the value means the narrower the particle size distribution range. Further, the toner particles in the slurry were observed using an optical microscope. From the observation, it was found that there was no white ball and the pigments are dispersed uniformly in the toner particles. The results are shown in Table 2.

After completing the polymerization reaction, the remained monomers were removed under reduced pressure. After cooling, dilute hydrochloric acid was added to dissolve the dispersant. Then, the sold/liquid separation, washing, filtration, drying, and classifying were performed to obtain polymerized toner particles. After classifying, fine particles and coarse particles having non-desired particle sizes were subjected to the measurements of their particle size distributions using a coulter multisizer. As a result, the average particle sizes of the fine particles and the coarse particles were D4=4.2 $\mu$m, and 14.5 $\mu$m, respectively.

100 parts by mass of the resulting cyan toner particles, and 1.5 parts by mass of hydrophobic titanium oxide fine particles having a specific surface area of 100 $m^2/g$ measured by the BET process were mixed, resulting in negatively friction charged cyan toner. The physical properties of the toner at the time of granulation and so on are shown in Table 2.

A developer was prepared by mixing 95 parts by mass of acryl-coated ferrite carrier with respect to 5 parts by mass of cyan toner. Then, an image formation with cyan toner was performed by a commercially available digital full color copying apparatus (CLC500, manufactured by Canon Inc.).

After completing the image formation, the measurement of the image density was performed. The image density was measured such that a solid image portion was formed and then the image density of the solid portion was measured using a MACBETH REFLECTION DENSITOMETER (manufactured by Macbeth Co., Ltd.). The results are shown in Table 2.

[Recycling Process]

Hereinafter, a description will be given of the process for recycling the resin composition including non-desired toner particles such as fine particles and coarse particles after the classification, ultra-fine particles adhered on a blower of the classify apparatus, and deposits on the wall surface of the vessel after the reaction.

Mixture III Other than the Desired Toner Particles

Fine particles, coarse particles, and bag fine particles generated as by-products in the method classification were uniformly mixed using a HENSCHEL MIXER to obtain the mixture III other than the desired toner particles. The THF-insoluble resin component of the mixture III other than the desired toner particles was measured. As a result, the amount thereof was 78% by mass.

Powder III of Kneaded Material

Subsequently, the mixture III other than the desired toner particles was kneaded repeatedly by a screw kneader to apply a shearing force to the THF-insoluble resin component. The molecular chain of the THF-insoluble resin component was cut off to make it into lower molecule. Further, at this time, the temperature of the processing substance was kept at 100° C. and kneaded was performed. After that, the processing substance was crushed with a speed mill to obtain the powder III of the kneaded material. The THF-insoluble resin component of the powder III of the kneaded material was subjected to the measurement. As a result, the content thereof was 18% by mass.

Mixture IV Other than the Desired Toner Particles

The deposits on the wall surface of the vessel were pulverized with a hammer mill to make it into fine particles to prepare scale fine particles. Subsequently, fine particles, coarse particles, and bag fine particles were uniformly mixed using a HENSCHEL MIXER to obtain the mixture IV other than the desired toner particles. The THF-insoluble resin component of the mixture IV other than the desired toner particles was subjected to the measurement. As a result, the content thereof was 90% by mass.

Powder IV of Kneaded Material

Subsequently, the mixture IV other than the desired toner particles was kneaded repeatedly by a screw kneader to apply a shearing force to the THF-insoluble resin component. The molecular chain of the THF-insoluble resin component was cut off to make it into lower molecule. Further, at this time, the temperature of the processing substance was kept at 100° C. and kneaded was performed. After that, the processing substance was crushed with a speed mill to obtain the powder IV of the kneaded material. The THF-insoluble resin component of the powder IV of the kneaded material was subjected to the measurement. As a result, the content thereof was 33% by mass.

Example 7

The same procedures as those of Reference Example 2 were performed except that the preparation of the polymerizable monomer composition, the amount of ester wax, and the amount of polymerization initiator were changed as described below. With respect to 273 parts by mass of the raw materials of toner obtained in Reference Example 2, 10% by mass portion was changed to the powder III of the kneaded material. The values of physical properties of toner are shown in Table 2.

| Preparation of polymerizable monomer composition | |
|---|---|
| Powder III of kneaded material: | 27.3 parts by mass (10% by mass with respect to toner raw material) |
| Styrene: | 145 × 0.9 parts by mass |
| 2-ethylhexyl acrylate: | 35 × 0.9 parts by mass |
| E-88 (manufactured by Orient Chemical Industries, Ltd.): | 2 × 0.9 parts by mass |
| Terephthalic acid-propyleneoxide modified bisphenol A (acid value 10 mgKOH/g m.w. 7500): | 20 × 0.9 parts by mass |
| Divinylbenzene: | 0.65 × 0.9 parts by mass |
| Colorant (C. I. pigment blue 15:3): | 14 × 0.9 parts by mass |

-continued

| Preparation of polymerizable monomer composition | |
|---|---|
| Ester wax to be added | |
| Ester wax (maximum value of heat-absorption peak of DSC: 72° C.): | 30 × 0.9 parts by mass |

Polymerization Initiator to be Added

A dissolving solution containing 6×0.9parts by mass of 2,2'-azobis (2,4-dimethylvaleronitrile)/20×0.9 parts by mass of styrene Example 8

The same procedures as those of Reference Example 2 were performed except that the preparation of the polymerizable monomer composition, the amount of ester wax to be used, and the amount of polymerization initiator were changed as described below. With respect to 273 parts by mass of the raw materials of toner obtained in Reference Example 2, a 20% by mass portion was changed to the powder III of the kneaded material. The values of physical properties of toner are shown in Table 2.

| Preparation of polymerizable monomer composition | |
|---|---|
| Powder III of kneaded material: | 54.6 parts by mass (20% by mass with respect to toner raw material) |
| Styrene: | 145 × 0.8 parts by mass |
| 2-ethylhexyl acrylate: | 35 × 0.8 parts by mass |
| E-88 (manufactured by Oriental Chemical Co., Ltd.): | 2 × 0.8 parts by mass |
| Terephthalic acid-propyleneoxide modified bisphenol A (acid value 10 mgKOH/g m.w.: 7500): | 20 × 0.8 parts by mass |
| Divinylbenzene: | 0.65 × 0.8 parts by mass |
| Colorant (C. I. pigment blue 15:3): | 14 × 0.8 parts by mass |
| Ester wax to be added | |
| Ester wax (maximum value of heat-absorption peak of DSC: 72° C.) | 30 × 0.8 parts by mass |

Polymerization Initiator to be Added

A dissolving solution containing 6×0.8 parts by mass of 2,2'-azobis (2,4-dimethylvaleronitrile)/20×0.8 parts by mass of styrene Example 9

The same procedures as those of Reference Example 2 were performed except that the preparation of the polymerizable monomer composition, the amount of ester wax to be used, and the amount of polymerization initiator were changed as described below. With respect to 273 parts by mass of the raw materials of toner in Reference Example 2, a 30% by mass portion was changed to the powder III of the kneaded material. The values of physical properties of toner are shown in Table 2.

| Preparation of polymerizable monomer composition | |
|---|---|
| Powder III of kneaded material: | 81.9 parts by mass (30% by mass with respect to toner raw material) |

-continued

| Preparation of polymerizable monomer composition | |
|---|---|
| Styrene: | 145 × 0.7 parts by mass |
| 2-ethylhexyl acrylate: | 35 × 0.7 parts by mass |
| E-88 (manufactured by Oriental Chemical Co., Ltd.): | 2 × 0.7 parts by mass |
| Terephthalic acid-propyleneoxide modified bisphenol A (acid value 10 mgKOH/g m.w. 7500): | 20 × 0.7 parts by mass |
| Divinylbenzene: | 0.65 × 0.7 parts by mass |
| Colorant (C. I. pigment blue 15:3): | 14 × 0.7 parts by mass |
| Ester wax to be added | |
| Ester wax (maximum value of heat-absorption peak of DSC: 72° C.): | 30 × 0.7 parts by mass |

Polymerization Initiator to be Added

A dissolving solution containing 6×0.7 parts by mass 2,2'-azobis (2,4-dimethylvaleronitrile)/20×0.7 parts by mass of styrene Example 10

The same procedures as those of Reference Example 2 were performed except that the preparation of the polymerizable monomer composition, the amount of ester wax to be used, and the amount of polymerization initiator were changed as described below. With respect to 273 parts by mass of the raw materials of toner obtained in Reference Example 2, a 35% by mass portion was changed to the powder III of the kneaded material. The values of physical properties of toner are shown in Table 2.

| Preparation of polymerizable monomer composition | |
|---|---|
| Powder III of kneaded material: | 95.6 parts by mass (35% by mass with respect to toner raw material) |
| Styrene: | 145 × 0.65 parts by mass |
| 2-ethylhexyl acrylate: | 35 × 0.65 parts by mass |
| E-88 (manufactured by Orient Chemical Industries, Ltd.): | 2 × 0.65 parts by mass |
| Terephthalic acid-propyleneoxide modified bisphenol A (acid value 10 mgKOH/g m.w. 7500): | 20 × 0.65 parts by mass |
| Divinylbenzene: | 0.65 × 0.65 parts by mass |
| Colorant (C. I. pigment blue 15:3): | 14 × 0.65 parts by mass |
| Ester wax to be added | |
| Ester wax (maximum value of heat-absorption peak of DSC: 72° C.): | 30 × 0.65 parts by mass |

Polymerization Initiator to be Added

A dissolving solution containing 6×0.65 parts by mass of 2,2'-azobis (2,4-dimethylvaleronitrile)/20×0.65 parts by mass of styrene Example 11

The same procedures as those of Reference Example 2 were performed except that the preparation of the polymerizable monomer composition, the amount of ester wax, and the amount of polymerization initiator were changed as described below, and that instead of the apparatus shown in FIG. 5, a dispersion and dissolution apparatus shown in FIG. 3 having an edged turbine blade and an anchor blade for stirring blades is used. With respect to 273 parts by mass of the raw materials of toner obtained in Reference Example 2, a 30% by mass portion was changed to the powder III of the kneaded material. The values of physical properties of toner are shown in Table 2.

| Preparation of polymerizable monomer composition | |
|---|---|
| Powder III of kneaded material: | 81.9 parts by mass (30% by mass with respect to toner raw material) |
| Styrene: | 145 × 0.7 parts by mass |
| 2-ethylhexyl acrylate: | 35 × 0.7 parts by mass |
| E-88 (manufactured by Orient Chemical Industries, LTD.): | 2 × 0.7 parts by mass |
| Terephthalic acid-propyleneoxide modified bisphenol A (acid value 10 mgKOH/g m.w. 7500): | 20 × 0.7 parts by mass |
| Divinylbenzene: | 0.65 × 0.7 parts by mass |
| Colorant (C. I. pigment blue 15:3): | 14 × 0.7 parts by mass |
| Ester wax to be added | |
| Ester wax (maximum value of heat-absorption peak of DSC: 72° C.): | 30 × 0.7 parts by mass |

Polymerization Initiator to be Added

A dissolving solution containing 6×0.7 parts by mass of 2,2'-azobis (2,4-dimethylvaleronitrile)/20×0.7 parts by mass of styrene Example 12

The same procedures as those of Reference Example 2 were performed except that the preparation of the polymerizable monomer composition, the amount of ester wax to be added, and the amount of polymerization initiator were changed as described below. With respect to 273 parts by mass of the raw materials of toner in Reference Example 2, a 10% by mass portion was changed to the powder IV of the kneaded material. The values of physical properties of toner are shown in Table 2.

| Preparation of Polymerizable monomer composition | |
|---|---|
| Powder IV of kneaded material: | 27.3 parts by mass (10% by mass toner raw material) |
| Styrene: | 145 × 0.9 parts by mass |
| 2-ethylhexyl acrylate: | 35 × 0.9 parts by mass |
| E-88 (manufactured by Orient Chemical Industries, LTD.): | 2 × 0.9 parts by mass |

-continued

| Preparation of Polymerizable monomer composition | |
|---|---|
| Terephthalic acid-propyleneoxide modified bisphenol A (acid value 10 mgKOH/g m.w. 7500): | 20 × 0.9 parts by mass |
| Divinylbenzene: | 0.65 × 0.9 parts by mass |
| Colorant (C. I. pigment blue 15:3): | 14 × 0.9 parts by mass |
| Ester wax to be added | |
| Ester wax (maximum value of heat-absorption peak of DSC: 72° C.): | 30 × 0.9 parts by mass |

Polymerization Initiator to be Added

A dissolving solution containing 6×0.9 parts by mass of 2,2'-azobis (2,4-dimethylvaleronitrile)/20×0.9 parts by mass of styrene.

Comparative Example 2

The same procedures as those of Reference Example 2 were performed except that the preparation of the polymerizable monomer composition, the amount of ester wax, and the amount of polymerization initiator were changed as described below. With respect to 273 parts by mass of the raw materials of toner obtained in Reference Example 2, a 10% by mass portion was changed to the mixture III (non-kneaded material). The values of physical properties of toner are shown in Table 2.

| Preparation of polymerizable monomer composition | |
|---|---|
| Mixture III other than prescribed toner particles: | 27.3 parts by mass (10% by mass with respect to toner raw material) |
| Styrene: | 145 × 0.9 parts by mass |
| 2-ethylhexyl acrylate: | 35 × 0.9 parts by mass |
| E-88 (manufactured by Orient Chemical Industries, LTD.): | 2 × 0.9 parts by mass |
| Terephthalic acid-propyleneoxide modified bisphenol A (acid value 10 mgKOH/g m.w. 7500): | 20 × 0.9 parts by mass |
| Divinylbenzene: | 0.65 × 0.9 parts by mass |
| Colorant (C. I. Pigment blue 15:3): | 14 × 0.9 parts by mass |
| Ester wax to be added | |
| Ester wax (Maximum value of heat-absorption peak of DSC: 72° C.) | 30 × 0.9 parts by mass |

Polymerization Initiator to be Added

A dissolving solution containing 6×0.9 parts by mass of 2,2'-azobis (2,4-dimethylvaleronitrile)/20×0.9 parts by mass of styrene

TABLE 2

| | Ratio of kneaded material powder | Dispersing apparatus | Stirring blade of stirrer | D4 (after classification) | Number variation coefficient | White ball observation | Image density |
|---|---|---|---|---|---|---|---|
| Reference Example 2 | · | Media type | Paddle | 6.91 | A | A | A |
| Example 7 | 10% by mass of kneaded material powder III | Media type | Paddle | 6.95 | A | A | A |
| Example 8 | 20% by mass of kneaded material powder III | Media type | Paddle | 7.29 | B | B | B |
| Example | 30% by mass of kneaded material powder III | Media type | Paddle | 7.38 | B | C | C |

TABLE 2-continued

| | Ratio of kneaded material powder | Dispersing apparatus | Stirring blade of stirrer | D4 (after classification) | Number variation coefficient | White ball observation | Image density |
|---|---|---|---|---|---|---|---|
| Example 10 | 35% by mass of kneaded material powder III | Media type | Paddle | 7.65 | C | C | C |
| Example 11 | 30% by mass of kneaded material powder III | Media type | Edged turbine and anchor | 7.27 | B | B | B |
| Example 12 | 10% by mass of kneaded material powder IV | Media type | Paddle | 7.33 | B | B | B |
| Comparative Example 2 | 10% by mass of mixture III | Media type | Paddle | 8.30 | D | D | D |

· Number variation coefficient
A: less than 28.0%
B: 28.1% or more and less than 32.0%
C: 32.1% or more and less than 36.0%
D: 36.1% or more
· White ball observation (at the time of completing polymerization)
A: no white ball
B: White balls are observed a little
C: White balls are observed, but no practical problem
D: White balls are observed at a practically unfavorable
· Image density
A: 1.4 or more
B: less than 1.4 and 1.2 or more
C: less than 1.2 and 1.0 or more
D: less than 1.0

What is claimed is:

1. A process for producing toner particles, in which a polymerizable monomer or a polymerizable monomer composition containing at least a polymerizable monomer is polymerized in an aqueous medium in a vessel to produce toner particles, the process comprising the steps of:

kneading a mixture containing at least a THF-insoluble resin component other than desired toner particles generated in the process for producing the toner particles to reduce an amount of the THF-insoluble resin component in the mixture thereby generating a kneaded material with reduced THF-insoluble resin component;

pulverizing the kneaded material to obtain powder of the kneaded material; and adding the powder of the kneaded material into a polymerizable monomer or a polymerizable monomer composition containing at least a polymerizable monomer.

2. The process for producing toner particles according to claim 1, wherein the amount of the powder of the kneaded material to be added into a polymerizable monomer or a polymerizable monomer composition containing at least a polymerizable monomer is 0.1% by mass to 30% by mass of an amount of materials to generate toner particles.

3. The process for producing toner particles according to claim 1, wherein an amount of the powder of the kneaded material to be added into a polymerizable monomer or a polymerizable monomer composition containing at least a polymerizable monomer is 0.1% by mass to 20% by mass of an amount of materials of toner particles.

4. The process for producing toner particles according to claim 1, wherein an amount of the powder of the kneaded material to be added into a polymerizable monomer or a polymerizable monomer composition containing at least a polymerizable monomer is 0.1% by mass to 10% by mass of a amount of materials of toner particles.

5. The process for producing toner particles according to claim 1, wherein an amount of the THF-insoluble resin component contained in the powder of the kneaded material is 40% by mass or less.

6. The process for producing toner particles according to claim 1, wherein an amount of the THF-insoluble resin component contained in the mixture containing at least a THF-insoluble resin component other than desired toner particles is 60% by mass or more and an amount of the THF-insoluble resin component contained in the powder of the kneaded material is 40% by mass or less.

7. The process for producing toner particles according to claim 1, wherein the mixture containing at least a THF-insoluble resin component other than desired toner particles comprises coarse particles, fine particles, or a mixture thereof.

8. The process for producing toner particles as claimed in claim 1, wherein the mixture containing at least a THF-insoluble resin component other than desired toner particles comprises deposits on a wall surface of the vessel.

9. The process for producing toner particles according to claim 1, further comprising the step of dispersing and dissolving the powder of the kneaded material added into a polymerizable monomer or a polymerizable monomer composition, wherein a dispersing and dissolving apparatus used in the step of dispersing and dissolving the powder of the kneaded material has at least two different stirring blades.

10. The process for producing toner particles according to claim 9, wherein the stirring blades are an edged turbine blade and an anchor blade.

* * * * *

UNITED STATES PATENT AND TRADEMARK OFFICE

CERTIFICATE OF CORRECTION

PATENT NO. : 6,953,648 B2
DATED : October 11, 2005
INVENTOR(S) : Takeshi Tsujino et al.

It is certified that error appears in the above-identified patent and that said Letters Patent is hereby corrected as shown below:

Column 2,
Line 28, “soon,” should read -- so on, --.

Column 4,
Line 66, “THE-insoluble” should read -- THF-insoluble --.

Column 16,
Line 24, “sodiumlaurate,” should read -- sodium laurate, --.

Column 19,
Line 41, “MIULTISIZER” should read -- MULTISIZER --; and
Line 44, “COLTLTER” should read -- COULTER --.

Column 21,
Line 1, “100parts” should read -- 100 parts --; and
Line 57, “a microscopic” should read -- microscopic --.

Column 23,
Line 60, “generation” should read -- generating --; and
Line 63, “material” should read -- materials --.

Column 24,
Line 27, “was,” should read -- wax, --; and
Line 31, “power I” should read -- powder I --.

Column 25,
Line 30, “chanted” should read -- changed --.

UNITED STATES PATENT AND TRADEMARK OFFICE

CERTIFICATE OF CORRECTION

PATENT NO. : 6,953,648 B2
DATED : October 11, 2005
INVENTOR(S) : Takeshi Tsujino et al.

It is certified that error appears in the above-identified patent and that said Letters Patent is hereby corrected as shown below:

Column 29,
Line 1, "(2,4-dimethylvaleronitnie)" should read -- 2,4-dimethylvaleronitrile) --.

Signed and Sealed this

Twenty-eighth Day of March, 2006

JON W. DUDAS
*Director of the United States Patent and Trademark Office*